US012000228B2

(12) United States Patent
Stokes et al.

(10) Patent No.: US 12,000,228 B2
(45) Date of Patent: Jun. 4, 2024

(54) FLOW DIVERSION VALVE FOR DOWNTOOL TOOL ASSEMBLY

(71) Applicant: Wellbore Integrity Solutions LLC, Houston, TX (US)

(72) Inventors: David A. Stokes, The Woodlands, TX (US); Gavin Ray Packard, Houston, TX (US); Adam M. Bennett, Spring, TX (US); Richard Caminari, The Woodlands, TX (US)

(73) Assignee: Wellbore Integrity Solutions LLC, Houston, TX (US)

( * ) Notice: Subject to any disclaimer, the term of this patent is extended or adjusted under 35 U.S.C. 154(b) by 0 days.

(21) Appl. No.: 17/879,761

(22) Filed: Aug. 2, 2022

(65) Prior Publication Data

US 2023/0068934 A1 Mar. 2, 2023

Related U.S. Application Data

(63) Continuation of application No. 17/003,912, filed on Aug. 26, 2020, now abandoned.

(Continued)

(51) Int. Cl.

*E21B 31/16* (2006.01)
*E21B 21/10* (2006.01)

(Continued)

(52) U.S. Cl.

CPC ..... *E21B 31/16* (2013.01); *E21B 21/103* (2013.01); *E21B 31/20* (2013.01); *E21B 29/005* (2013.01)

(58) Field of Classification Search

CPC ..... E21B 31/16; E21B 21/103; E21B 31/20; E21B 29/005

(Continued)

(56) References Cited

U.S. PATENT DOCUMENTS 7,762,330 B2 * 7/2010 Saylor, III ..... E21B 31/16 166/298
8,869,896 B2 * 10/2014 Crow ..... E21B 31/20 166/54.5

(Continued)

FOREIGN PATENT DOCUMENTS

GB 2590757 7/2021

OTHER PUBLICATIONS

Combined Search and Examination Report Under Sections 17 and 18(3) for App. No. GB2013370.8, dated Apr. 30, 2021, 11 pages.

(Continued)

*Primary Examiner* — Taras P Bemko
(74) *Attorney, Agent, or Firm* — Hubbard Law, PLLC

(57) ABSTRACT

A casing removal system includes a flow diversion valve. The flow diversion valve includes a flow switch that engages an upper end of an inner casing. When the flow switch engages the upper end of the inner casing, the flow diversion valve opens and at least a portion of the fluid flow through the casing removal system exhausts to the annulus. The remaining fluid flow below the flow diversion valve is insufficient to operate a mud motor that drives a casing cutter. In other embodiments, when the flow switch is not engaged with the inner wall of casing, the flow diversion valve prevents fluid flow to components that are downhole of the valve and when the flow switch is engaged with the inner wall of casing, the flow diversion valve allows for fluid flow to components that are downhole of the valve.

17 Claims, 16 Drawing Sheets

Related U.S. Application Data

(60) Provisional application No. 62/891,451, filed on Aug. 26, 2019.

(51) Int. Cl.
*E21B 31/20* (2006.01)
*E21B 29/00* (2006.01)

(58) Field of Classification Search
USPC ..... 166/298
See application file for complete search history.

(56) References Cited

U.S. PATENT DOCUMENTS

| | | | | |
|---|---|---|---|---|
| 9,650,853 | B2 * | 5/2017 | Lehr | E21B 29/002 |
| 10,487,605 | B2 * | 11/2019 | Nelson | E21B 33/12 |
| 11,352,844 | B2 * | 6/2022 | von Gynz-Rekowski | E21B 21/103 |
| 2007/0163808 | A1 * | 7/2007 | Campbell | E21B 10/322 175/269 |
| 2014/0251616 | A1 * | 9/2014 | O'Rourke | E21B 33/1208 166/55.7 |
| 2016/0201413 | A1 | 7/2016 | White | |
| 2016/0326863 | A1 | 11/2016 | Lange | |
| 2019/0136653 | A1 * | 5/2019 | Hern | E21B 34/14 |
| 2019/0162046 | A1 * | 5/2019 | Engevik | E21B 31/20 |
| 2019/0257168 | A1 * | 8/2019 | Sunde | E21B 29/002 |
| 2020/0088003 | A1 * | 3/2020 | Wardley | E21B 31/20 |
| 2021/0115747 | A1 | 4/2021 | Stokes | |
| 2022/0065062 | A1 | 3/2022 | Caminari | |

OTHER PUBLICATIONS

Examination Report for App. No. GB2013370.8, dated May 9, 2022, 3 pages.
Examination Report for App. No. GB2013370.8, dated Oct. 21, 2021, 4 pages.
Office Action (Ex Parte Quayle Action) dated Jun. 12, 2023 for U.S. Appl. No. 17/458,481 (pp. 1-5).
Office Action (Non-Final Rejection) dated Sep. 16, 2022 for U.S. Appl. No. 17/458,481 (pp. 1-6).
Office Action (Notice of Allowance and Fees Due (PTOL-85)) dated Aug. 31, 2023 for U.S. Appl. No. 17/458,481 (pp. 1-9).
Response dated Aug. 27, 2021, to Combined Search and Examination Report Under Sections 17 and 18(3) for App. No. GB2013370.8, dated Apr. 30, 2021.
Response dated Mar. 21, 2022, to Examination Report for App. No. GB2013370.8, dated Oct. 21, 2021, 8 pages.
Response dated Oct. 11, 2022, to Examination Report for App. No. GB2013370.8, dated May 9, 2022.

* cited by examiner

FLOW DIVERSION VALVE FOR DOWNTOOL TOOL ASSEMBLY

CROSS-REFERENCE TO RELATED APPLICATIONS

This application is a continuation of U.S. application Ser. No. 17/003,912 filed Aug. 26, 2020, which claims the benefit of U.S. provisional patent application No. 62/891,451, filed Aug. 26, 2019, both of which are incorporated herein by reference for all purposes.

BACKGROUND OF THE DISCLOSURE

Well bores may be lined with one or more casings. Casings are installed to provide structure and geotechnical support for the wellbore, to facilitate fluid flow through the wellbore, and for many other reasons. Over the course of a wellbore's operational lifetime, and at the end of the wellbore's operational lifetime, it may be desirable to remove a casing. Casing removal involves gripping the casing with a spear and applying a removal force on the casing. If the removal force is insufficient to remove the casing, the casing may be cut to reduce the length of the casing to be removed, and therefore reduce the total strength of the connection holding the casing in the wellbore.

SUMMARY

In one representative embodiment, a flow diversion valve is comprised of housing with upper and lower ends configured for coupling to another downhole tool to form a downhole tool assembly. The housing having defined through it a flow path and actuatable valve interposed in the flow path to control fluid flow from the lower end of the housing. The flow diversion valve has least one movable actuation member that extends beyond the outer diameter of the housing under the influence of a biasing force and is configured to be the moved at least partially inwardly with respect to the housing against the biasing force when the flow diversion valve passes from a first casing to a second casing that has an inner diameter smaller than the inner diameter of the first casing. Movement of the actuating member changes the rate of fluid flow existing the flow diversion valve.

In one example of this representative embodiment, the flow diversion valve is configured to restrict fluid flow in the fluid flow path in response to extension of the actuating member and to open the fluid flow in the fluid flow path in response to inward movement of the actuating member.

In another example of this representative embodiment, the actuatable valve is configured to divert at least a portion of fluid flowing in the flow path through an opening in the housing in response to an inward deflection of the actuation member, thereby reducing the rate of fluid flow from the end of lower end of the housing.

A representative, non-limiting embodiment of a method using a flow diversion valve in a downhole assembly comprises lowering the assembly on a work or drill string into a wellbore, the assembly being coupled to the string to receive fluid under pressure from the string. The assembly comprises at least a first tool, a second tool, and a flow diversion valve located between the first and second tools for controlling the flow of fluid through the assembly from the first tool to the second tool, the flow diversion valve including a body on which is mounted at least one actuating member that is movable with respect to the housing between an extended position, in which they extend laterally outwardly beyond the body by application of a biasing force, and a retracted position in which it is displaced inwardly against the biasing force. The method further comprises lowering the assembly through a first casing having a first inner diameter and continuing to lower at least part of the assembly, including the flow diversion valve, into a second casing having a second diameter, the second inner diameter being smaller than the first inner diameter, the at least one actuating member of the flow diversion valve thereby being moved inwardly to provide clearance and cause the flow diversion valve to change from a first fluid flow control state to a second fluid flow control state, the valve in the first fluid control state restricting fluid flow out of the lower end of the flow diversion valve as compared to the second fluid control state.

In one non-limiting example of this representative embodiment of the method, the first tool in the assembly comprises a jack configured for anchoring to first casing and the second tool comprises a motor connected with a cutter capable of cutting the second casing.

In another embodiment, a flow diversion valve includes a housing. The housing includes an opening from an inner surface to an outer surface. A housing port is offset from the opening. A central bore runs through the housing. A flow diverter is located in the housing. The flow diverter is movable between a first and a second position. In the first position, the flow diverter blocks a fluid flow from flowing from the central bore out of the housing port. In the second position, the housing port is uncovered so that at least a portion of the fluid flow flows from the central bore out of the housing through the housing port.

In another example of system for removing a casing from a wellbore includes a jack configured to exert an upward force on a string of tools. The string of tools includes a spear configured to attach to the casing and a mud motor downhole of the spear, the mud motor driving a casing cutter used to sever the casing to be retrieved. The mud motor generates rotational power in response to a minimum fluid flow. The system includes a flow diversion valve between the jack and the mud motor. The flow diversion valve includes a housing with an opening between an interior of the housing and an exterior of the housing. The flow diversion valve includes a flow diverter in the interior of the housing. The flow diverter is movable between a first diverter position and a second diverter position. In the first flow diverter position a fluid flow flows through a central bore of the housing. In the second flow diverter at least a portion of the fluid flow flows from the interior of the housing to the exterior of the housing so that less than the minimum fluid flow flows to the mud motor. A flow switch extends through the opening to contact the flow diverter. The flow switch is rotatable between a first switch position and a second switch position. In the first switch position the flow diverter is in the first diverter position, and in the second switch position the flow diverter is in the second diverter position.

In yet some embodiments, a method for removing an inner casing internal to an outer casing includes flowing a fluid flow through a flow diversion valve in a housing, the fluid flow including a first flow rate below the flow diversion valve. The method includes lowering the housing through the outer casing to the inner casing. A flow switch of the flow diversion valve is engaged on the inner casing. The flow switch extends from inside the housing to outside the housing. Engaging the flow switch including moving a flow diverter such that the flow diverter opens a housing port in the housing. The method further includes flowing at least a portion of the fluid flow through the housing port so that the fluid flow includes a second flow rate below the diversion valve.

This summary is not intended to identify key or essential features of the claimed subject matter, nor is it intended to be used as an aid in limiting the scope of the claimed subject matter. Various embodiments and features and aspects of various embodiments are described below.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 3-1 is a representation of a flow diversion valve in a closed position, according to at least one embodiment of the present disclosure;

FIG. 3-2 is a representation of the flow diversion valve of FIG. 3-1 in an open position, according to at least one embodiment of the present disclosure;

FIG. 4-1 is a representation of a portion of a casing removal system in a closed position, according to at least one embodiment of the present disclosure;

FIG. 4-2 is a representation of the portion of the casing removal of FIG. 4-1 in an open position, according to at least one embodiment of the present disclosure;

FIG. 5-1 is a representation of another flow diversion valve, according to at least one embodiment of the present disclosure;

FIG. 5-2 is a representation of the flow diversion valve of FIG. 5-1, according to at least one embodiment of the present disclosure;

FIG. 6-1 is a representation of a casing removal system in an open position, according to at least one embodiment of the present disclosure;

FIG. 6-2 is a representation of the casing removal system of FIG. 6-1 in a closed position, according to at least one embodiment of the present disclosure;

FIG. 6-3 is a representation of the casing removal system of FIG. 6-1 in the open position, according to at least one embodiment of the present disclosure;

FIG. 9-1 is a cross-sectional view of a second, representative embodiment of a flow diversion valve in a first position;

FIG. 9-2 is the cross-section view of the flow diversion valve of FIG. 9-1 with the valve diversion valve in a second position; and FIG. 9-3 is the cross-sectional view of the flow diversion valve of FIGS. 9-1 and 9-2 in a third position.

DETAILED DESCRIPTION

This disclosure generally relates to devices, systems, and methods for removing a casing from a wellbore. The system includes a flow diversion valve. When the flow diversion valve is closed, a fluid flow may drive a mud motor, which powers a casing cutter. To open the flow diversion valve, the flow diversion valve is lowered below a stump of an inner casing. When the flow diversion valve is open, at least a portion of the fluid flow may be diverted to the annulus between the flow diversion valve and the casing. The portion of the fluid flow diverted to the annulus is such that, downhole of the flow diversion valve, the fluid flow is insufficient to drive the mud motor. Thus, when the flow diversion valve is open, a hydraulically powered jack may pull on a spear connected to the casing without driving the mud motor. Therefore, by raising and lowering the flow diversion valve above and below the stump of the inner casing, the casing removal system may cycle between pulling on the casing and driving a mud motor to operate a casing cutter. In contrast to conventional casing removal systems, which require a different trip into the wellbore for each step, in at least one implementation described herein, utilizing a flow diversion valve may allow pulling on the casing with a hydraulically powered jack and cutting of the casing with a casing cutter powered by a mud motor to occur in the same trip. This may reduce the number of trips in and out of the wellbore, thereby reducing the time and cost of removing the casing.

Figure 1:
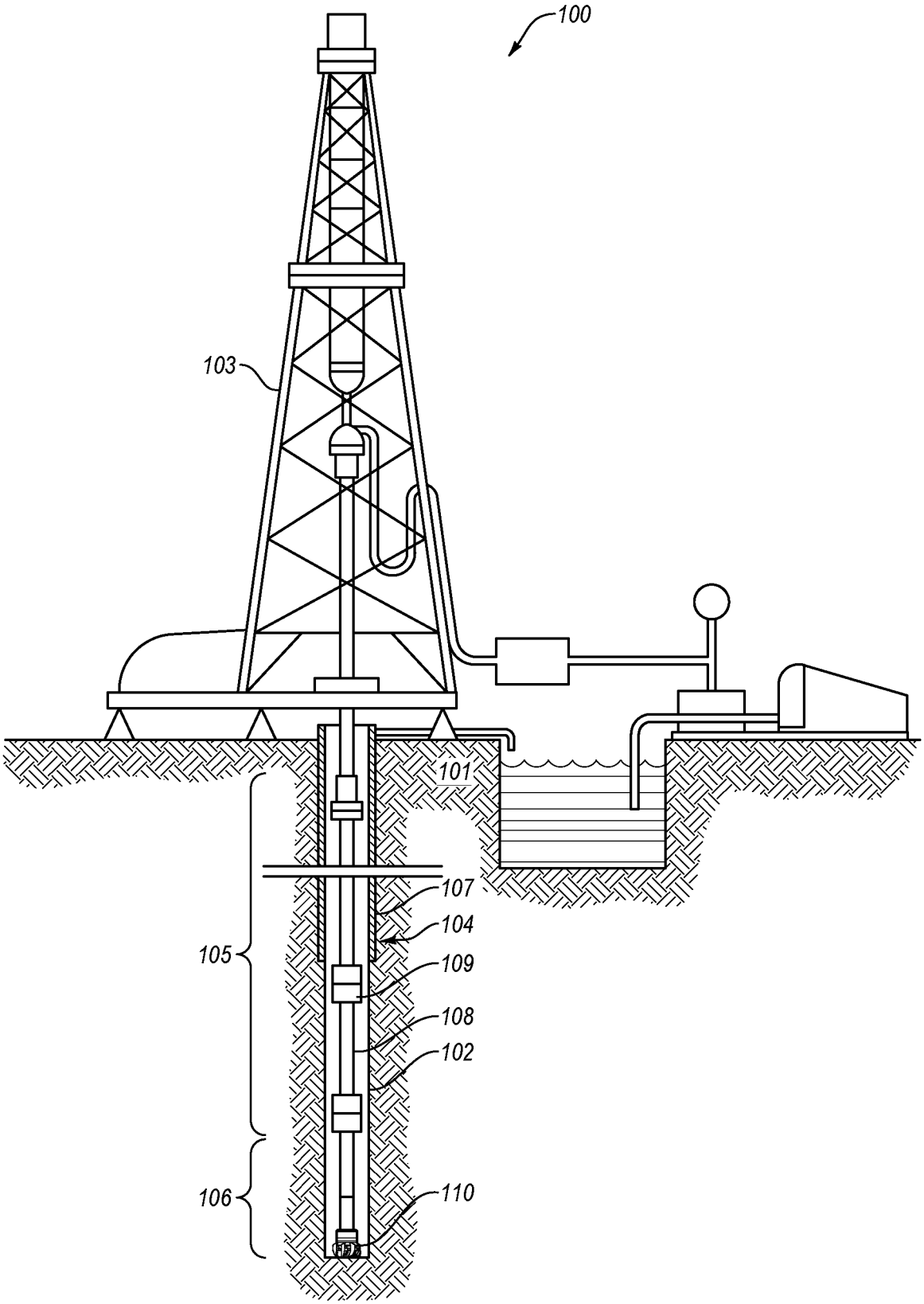
FIG. 1 is a representation of a drilling system, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between the drill string 105 and the bit 110). Examples of additional BHA components include drill collars, stabilizers, measurement-while-drilling ("MWD") tools, logging-while-drilling ("LWD") tools, downhole motors, underreamers, casing cutters, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In some embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figure 2:
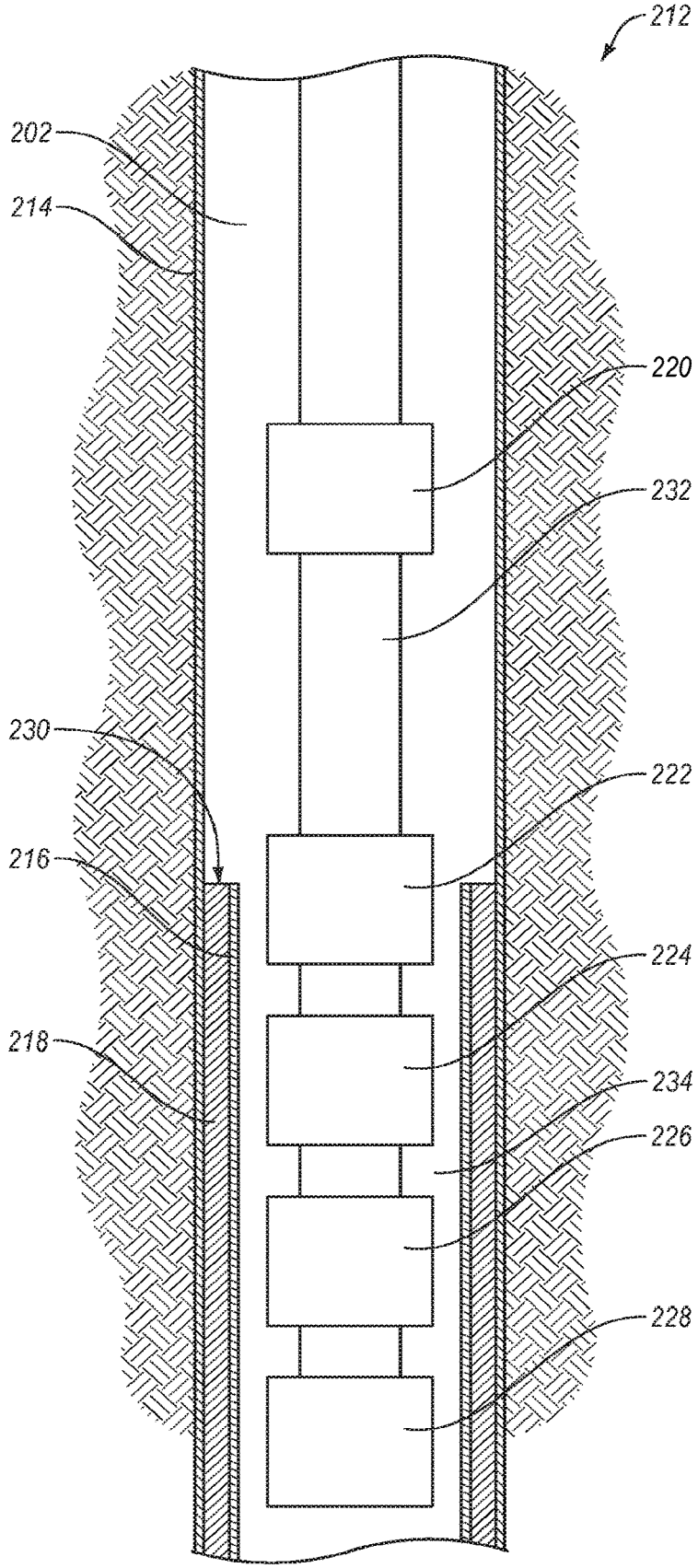
FIG. 2 is a representation of a casing removal system, according to at least one embodiment of the present disclosure.

FIG. 2 is a schematic representation of a casing removal system 212, according to at least one embodiment of the present disclosure. The casing removal system 212 includes a plurality of downhole tools located inside the wellbore 202. The wellbore 202 is lined with a first casing 214 (e.g., an outer casing) and a second casing 216 (e.g., an inner casing), the second casing 216 being internal to the first casing 214. In some embodiments, the second casing 216 may be connected to the first casing 214 with a layer or a ring of material 218, such as cement, cementitious grout, chemical grout, concrete, or any other material used to connect the second casing 216 to the first casing 214.

During operation of the casing removal system 212, a spear 222 is lowered below an upper end 230 of the second casing 216 (e.g., at a stump, a shoulder, or a shelf of the second casing 216). The spear 222, located below a jack 220, may engage the second casing 216, and the jack 220 may exert an upward force on a connecting tubular 232 to try to dislodge the second casing 216. In some embodiments, the jack 220 may engage the first casing 214 while exerting the upward force on the connecting tubular 232. This may allow the jack 220 to increase the force exerted on the connecting tubular 232. If the second casing 216 is not dislodged, then a portion of the second casing 216 is cut with a casing cutter 228 powered by a mud motor 226 (e.g., a positive displacement motor, a progressive cavity motor, or a turbine generator). After the second casing 216 is cut, the spear 222 engages the second casing 216 again, and the jack 220 exerts an upward force on the second casing 216.

In some embodiments, the casing removal system 212 may include more downhole tools than those listed or shown in FIG. 2. For example, the casing removal system 212 may include one or more stabilizers, MWD, LWD, bit, RSS, any other portion of a BHA, and combinations of the foregoing. In some embodiments, the downhole tools shown in the casing removal system 212 may be located in a different order than the order shown in FIG. 2.

The jack 220 and the mud motor 226 (and therefore the casing cutter 228) are hydraulically powered. To prevent undesirable milling of the second casing 216 while applying force with the jack 220, the mud motor 226 may be shut off when the flow diversion valve 224 is below the upper end 230 of the second casing 216. The flow diversion valve 224 is actuated (e.g., opened) by lowering the flow diversion valve 224 below the upper end 230 of the second casing 216, which diverts flow out of a central bore of the casing removal system 212 and into an annulus 234 of the wellbore, thereby preventing an operating flow from reaching the mud motor 226. This may allow the casing removal system 212 to cycle between operating the jack 220 and operating the mud motor 226 in the same trip downhole, thereby reducing the number of trips used to remove the second casing 216, which may save time and money.

Figures 1, 3:
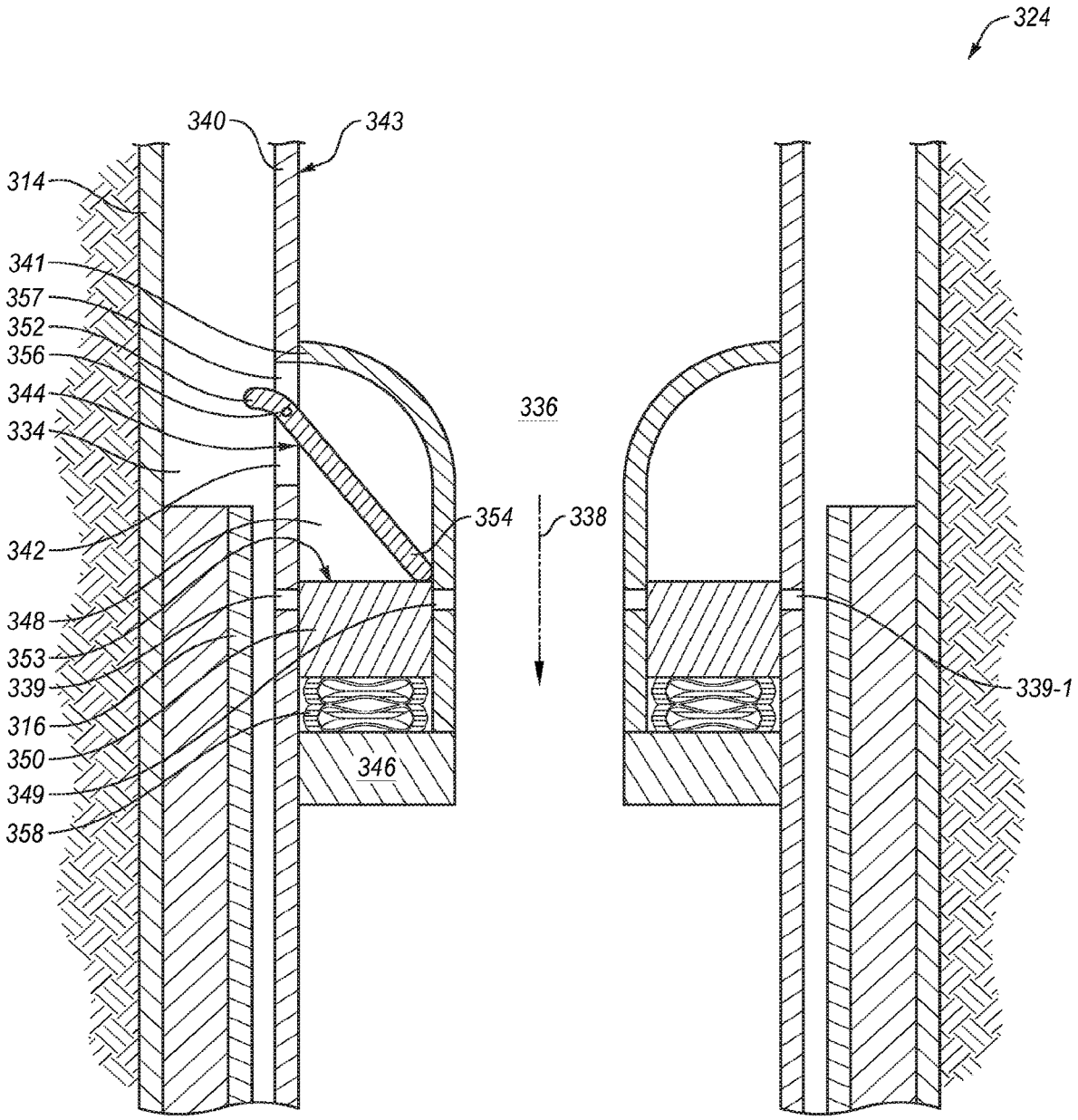
Figures 2, 3:
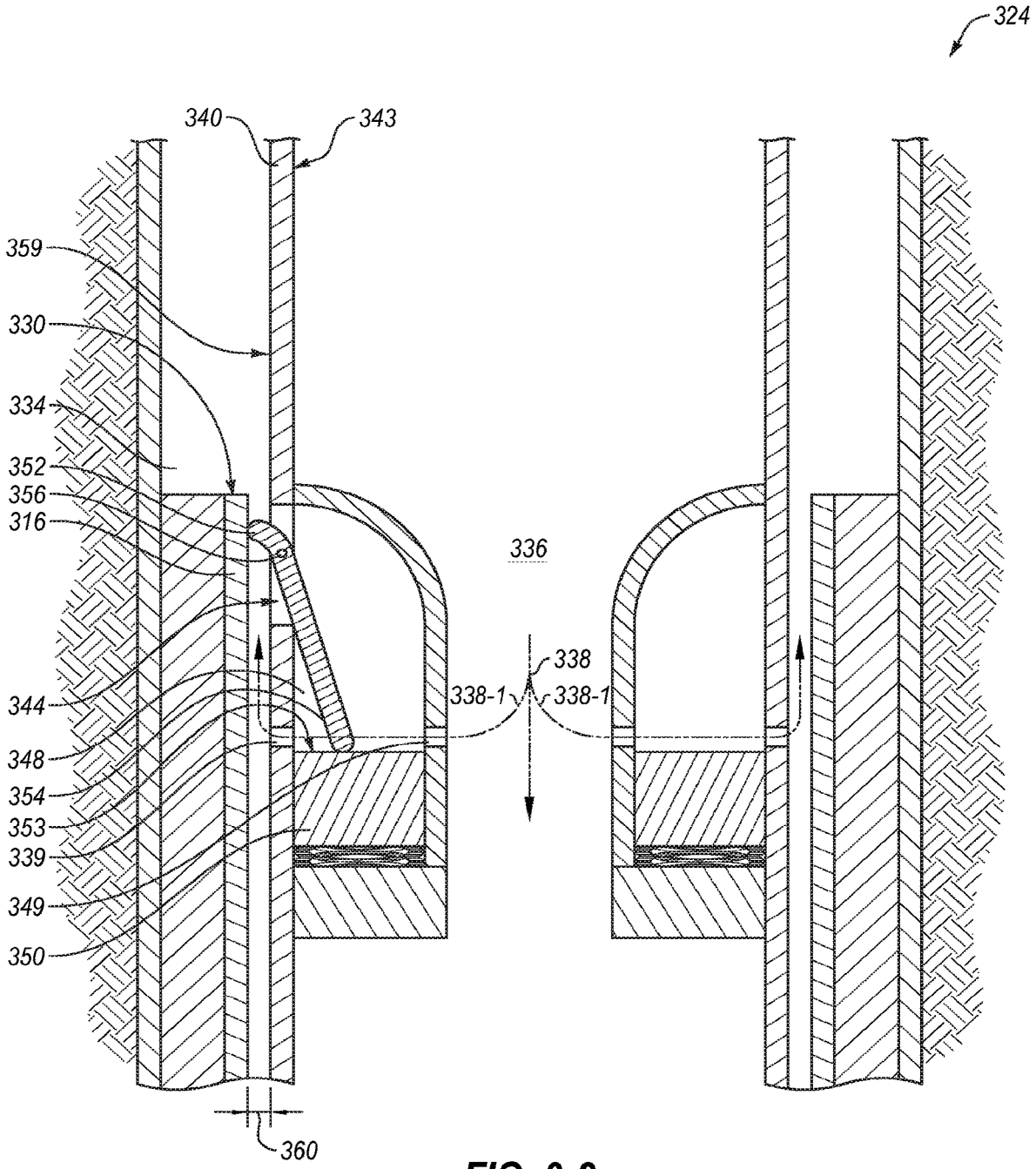

FIG. 3-1 is a representation of a flow diversion valve 324, according to at least one embodiment of the present disclosure. The flow diversion valve 324 includes a central bore 336 through which a fluid flow 338 flows. The central bore 336 extends through a casing removal system (e.g., casing removal system 212 of FIG. 2) from a jack (e.g., jack 220 of FIG. 2) to a casing cutter (e.g., casing cutter 228 of FIG. 2). The flow diversion valve 324 includes a housing 340 with an opening 342. The housing 340 further includes a housing port 339 through the housing 340 below the opening 342.

The flow diversion valve 324 includes a sleeve 341 that extends from an inner surface 343 of the housing 340 into the central bore 336. The sleeve 341 is connected to the inner surface 343 of the housing 340 above the opening 342, and extends into the central bore past the opening 342 and the flow switch 344. In other words, the sleeve 341 may extend downhole from where it is attached to the inner surface 343 of the housing 340. The sleeve 341 is supported on a downhole side by a sleeve support 346. The sleeve 341 and the sleeve support 346 form a valve chamber 348 between the sleeve 341 and the inner surface 343 of the housing 340. The sleeve 341 includes a sleeve port 349 hydraulically connecting (e.g., in fluid communication with) the central bore 336 to the valve chamber 348.

A flow diverter 350 is located in the valve chamber 348 and extends from the inner surface 343 to the sleeve 341. In the position shown (e.g., the closed position) in FIG. 3-1, the flow diverter 350 may block some or all of the fluid flow 338 from flowing from the central bore 336, through the sleeve port 349 into the valve chamber 348, and from the valve chamber 348 out of the housing port 339 into the annulus 334. Thus, in the closed position, the fluid flow 338 may flow through the flow diversion valve 324 to the mud motor (e.g., mud motor 226 of FIG. 2).

The flow diversion valve 324 further includes a flow switch 344 that extends through the opening 342 into an annulus 334 between the housing 340 and the first casing 314 and/or the second casing 316. The flow switch 344 includes an outer portion 352 (e.g., a first end) and an inner portion 354 (e.g., a second end). The outer portion 352 extends out of the housing 340 through the opening 342. The inner portion 354 extends through the opening 342 into the valve chamber 348.

In some embodiments, the flow switch 344 pivots between a first switch position (e.g., a closed switch position, as shown in FIG. 3-1), and a second switch position (e.g., an open switch position, as shown in FIG. 3-2). For example, a pin 356 may extend across the opening 342 and through the flow switch 344. The flow switch 344 may be rotationally connected to the pin 356 such that the flow switch rotates relative to or about the pin 356. In some embodiments, the pin 356 may be rotationally fixed to the flow switch 344, and the pin 356 may be rotationally connected to the inner walls 357 of the opening 342. In some embodiments, the flow switch 344 may be rotationally connected to the opening 342 with a hinge, a bolt, a bearing, a shank, a rod, any other rotational connection, and combinations thereof.

In some embodiments, for example, in the embodiment shown, the pin 356 may be connected to the housing 340 at inner walls 357 of the opening 342. In some embodiments, the pin 356 may be connected to the housing 340 with a bracket or an axle that is offset to the inside or the outside of the opening 342. In this manner, the rotational axis of the flow switch 344 may be located in an optimized position. For example, by locating the pin 356 inside the valve chamber 348, the inner portion 354 of the flow switch 344 may rotate closer to the inner surface 343 of the housing 340.

The inner portion 354 of the flow switch 344 is configured to engage with an upper surface 353 of the flow diverter 350. As the flow switch 344 rotates (in a clockwise direction in the view shown in FIG. 3-1), the inner portion 354 pushes the flow diverter 350 downward until a hydraulic pathway is opened between the central bore 336 and the annulus 334. Thus, in a first flow diverter position, fluid communication between the central bore 336 and the annulus 334 is reduced or eliminated by the flow diverter 350. In a second flow diverter position, fluid communication between the central bore 336 and the annulus 334 is opened. In other words, fluid communication between the central bore 336 and the annulus 334 is opened when the flow diverter moves between the first diverter position and the second diverter position For example, the flow diverter 350 may move downward until the sleeve port 349 and the housing port 339 are uncovered. Thus, the flow diverter 350 is moved longitudinally in the housing 340, or parallel to a longitudinal axis of the flow diversion valve 324 (e.g., parallel to a longitudinal axis of the casing removal system 212 of FIG. 2). The flow diverter 350 is moved between a first diverter position (e.g., a closed diverter position, as shown in FIG. 3-1) and a second diverter position (e.g., an open diverter position, as shown in FIG. 3-2). Thus, the flow diversion valve 324 is actuated by rotating the flow switch 344 from the closed switch position to the open switch position, which pushes the flow diverter 350 downward from the closed diverter position to the open diverter position. In some embodiments, the flow switch 344 may include a torsion spring which rotates the flow switch 344 such that the inner portion 354 is in constant contact or is urged to be in constant contact with the upper surface 353 of the flow diverter 350.

In the embodiment shown, the upper surface 353 is perpendicular to the inner surface 343 of the housing 340. In some embodiments, the upper surface 353 may be oriented at an angle with respect to the inner surface 343 of the housing 340. For example, an end of the upper surface 353 next to the inner surface 343 may be higher than an end of the upper surface 353 near the sleeve 341. In other examples, the end of the upper surface 353 next to the inner surface 343 may be lower than the end of the upper surface 353 near the sleeve 341. Changing the orientation of the upper surface 353 may change how the upper surface 353 moves with respect to a change in rotation of the flow switch. For example, an upper surface 353 oriented with an inner surface 343 end higher than the sleeve 341 end may move longitudinally further. This may increase the sensitivity of the flow diversion valve 324, which may therefore utilize a smaller rotation of the flow switch 344 to activate.

A resilient member 358 urges the flow diverter 350 upward, or toward the first diverter position. In this manner, the flow switch 344 may overcome the upward force of the resilient member 358 on the flow diverter 350 to move the flow diverter 350 from the closed position to the open position (e.g., to uncover the sleeve port 349 and the housing port 339). The resilient member 358 may be any resilient member, including one or more of disc spring, a Belleville washer, one or more coil springs, a wave spring, a hydraulic piston, or any other resilient member. In some embodiments, the resilient member 358 may be supported by the sleeve support 346. In some embodiments, the resilient member 358 may be supported by another support member or ring.

Thus, the flow diversion valve 324 is normally closed absent a downward force on the flow diverter 350. In other words, the fluid flow 338 is directed to the mud motor unless the flow diversion valve 324 is opened. In this manner, the mud motor may be actuated simply by starting or resuming the fluid flow 338 as long as the flow switch 344 is in the position shown in FIG. 3-1, or the closed position. This may be accomplished, for example, by starting the mud pumps on the surface.

In some embodiments, the flow diverter 350 is an annular ring or disc that extends around an entirety of the inner surface 343 of the housing 340. In some embodiments, the flow diverter 350 may be broken up into a plurality of flow diverter sections. The flow diverter 350 may include a single flow diverter section per flow switch 344. This may improve actuation of the flow diversion valve 324 by reducing the mass of the flow diverter 350 to be actuated.

FIG. 3-2 is a representation of the flow diversion valve 324 of FIG. 3-1 in the open position, according to at least one embodiment of the present disclosure. To move from the closed position shown in FIG. 3-1 to the open position shown in FIG. 3-2, the housing 340 of the flow diversion valve 324 is moved downhole toward the upper end 330 of the second casing 316 (e.g., the stump of the inner casing). The outer portion 352 of the flow switch 344 radially extends past the outer surface 359 of the housing 340 with a distance that is greater than an inner annular gap 360 between the outer surface 359 and the second casing 316.

As the housing 340 is lowered past the upper end 330 of the second casing 316, the upper end 330 and/or inner surface of the second casing 316 may push against the outer portion 352 of the flow switch 344, thereby causing the flow switch 344 to rotate about the pin 356 from the first switch position (e.g., the closed switch position shown in FIG. 3-1) to the second switch position (e.g., the open switch position shown in FIG. 3-2). As the flow switch 344 rotates about the pin 356, the inner portion pushes against the upper surface 353 of the flow diverter 350. This may cause the flow diverter 350 to move from the first diverter position (e.g., the closed diverter position shown in FIG. 3-1) to the second diverter position (e.g., the open diverter position shown in FIG. 32). In this manner, the flow diversion valve may move from the closed position shown in FIG. 3-1 to the open position shown in FIG. 3-2.

As the flow diverter 350 moves from the closed diverter position to the open diverter position, the sleeve port 349 and the housing port 339 may be uncovered. This may open a fluid path from the central bore 336 to the annulus 334. In this manner, at least a portion 338-1, and possibly all, of the fluid flow 338 may flow through the sleeve port 349 into the valve chamber 348, and out of the valve chamber 348 through the housing port 339 into the annulus 334. Thus, by moving the flow diverter 350 from the closed diverter position to the open diverter position, the flow diversion valve 324 may divert some or all of the fluid flow 338 to the annulus 334. The reduced fluid flow 338 below the flow diversion valve 324 may be insufficient to operate the mud motor. Therefore, when pumping fluid through the casing removal system, the fluid flow 338 may be diverted to the annulus 334 such that the mud motor does not rotate and the casing cutter does not cut a portion of the second casing 316. This may allow a hydraulically powered jack (e.g., jack 220 of FIG. 2) to operate independent of the mud motor. Operating the jack independently of the mud motor may allow casing removal system to perform a casing removal operation in a single downhole trip by allowing the casing removal system to sequence between pulling of the second casing 216 by the jack and cutting of the second casing 216 by the casing cutter. This may save the drilling operator time and money.

In some embodiments, the portion 338-1 of the fluid flow 338 flows to the annulus 334 through the sleeve port 349 and the housing port 339 rather than down to the mud motor because flowing to the annulus 334 through the valve chamber 348 has a lower hydraulic resistance than flowing through the mud motor. Thus, when the flow diversion valve 324 is opened, a hydraulic short-circuit is opened from the central bore 336 to the annulus 334. In this manner, the flow diversion valve 324 may divert flow away from the mud motor and to the annulus 334. Thus, the casing removal system may include independently operating hydraulic tools, such as the jack and the mud motor. This may allow two different hydraulically activated tools to be actuated based on the location of the downhole tool within the wellbore.

In some embodiments, moving the flow diverter 350 downhole may uncover both the sleeve port 349 and the housing port 339 at the same time. In some embodiments, moving the flow diverter 350 downhole may uncover the sleeve port 349 before the housing port 339. This may allow the valve chamber 348 to equalize pressure with the central bore 336 before uncovering the housing port 339. In some embodiments, moving the flow diverter 350 downhole may uncover the housing port 339 before the sleeve port 349. This may allow the valve chamber 348 to equalize pressure with the annulus 334 before uncovering the sleeve port 349.

In some embodiments, the housing 340 may include a plurality of openings 342 with a plurality of flow switches 344 extending through the openings 342 and all exerting a force on the flow diverter 350. For example, the housing 340 may include 2, 3, 4, 5, 6, 7, 8, 9, 10, 11, 12, or more openings 342 and flow switches 344. In some embodiments, an opening 342 may include more than one flow switch 344. For example, an opening 342 may include 2, 3, 4, 5, 6, or more flow switches. In some embodiments, the openings 342 and flow switches 344 may be equally spaced around the outer circumference of the housing 340 (i.e., spaced with equal radial distances between each opening 342 and flow switch 344). In some embodiments, the openings 342 and the flow switches 344 may be unequally spaced around the outer circumference of the housing 340.

In some embodiments, the housing port 339 may be aligned with (e.g., longitudinally aligned with) the opening 342. In some embodiments, the housing port 339 may be unaligned with the opening 342. For example, in the embodiment shown, the housing port 339 is longitudinally aligned with the opening 342. However, the housing port 339-1 may not be longitudinally aligned with any opening 342.

In some embodiments, the housing 340 may include the same number of housing ports 339 as openings 342 (i.e., a single housing port 339 associated with a single opening 342). In some embodiments, the housing 340 may include more housing ports 339 than openings 342. In some embodiments, the housing 340 may include more openings 342 than housing ports 339. In some embodiments, the housing 340 may not include any housing ports 339. For example, the portion of the fluid flow may flow out of the valve chamber 348 through the opening 342.

The sleeve 341 may include a plurality of sleeve ports 349. In some embodiments, the sleeve 341 may include the same number of sleeve ports 349 as the housing 340 includes housing ports 339. In some embodiments, the sleeve 341 may include more sleeve ports 349 than housing ports 339. In some embodiments, the sleeve 341 may include fewer sleeve ports 349 than housing ports 339. In some embodiments the sleeve ports 349 may be radially aligned with the housing ports 339 (i.e., on the same radial path from the central bore 336 out toward the housing 340). In some embodiments the sleeve ports 349 may not be radially aligned with the housing ports.

By selecting the number, location, orientation, and placement of the sleeve ports 349 and housing ports 339, the hydraulic pathway from the central bore 336 to the annulus 334 may be optimized. For example, an increase in the number of sleeve ports 349 may decrease the velocity of the fluid flow entering the valve chamber 348. A decrease in the number of housing ports 339 may increase the pressure differential between the central bore 336 and the annulus 334, which may divert less of the fluid flow 338 to the annulus 334. Aligning the sleeve ports 349 with the housing ports 339 may reduce the turbulence of the diverted fluid flow 338 in the valve chamber 348, which may increase the flow from the central bore 336 to the annulus 334. Thus, by changing the configuration of the sleeve ports 349 and the housing ports 339, the hydraulic properties and pathway of the diverted portion of the fluid flow 338 may be optimized.

In some embodiments, the housing ports 339 and/or the sleeve ports 349 may include a nozzle. The nozzle may be selected for a specific pressure drop between the central bore 336 and the annulus 334. In this manner, the portion of the fluid flow that flows to the annulus 334 in the open position may be controlled by controlling the diameter of the nozzle installed in the housing port 339 and/or the sleeve port 349.

In some embodiments, the flow switch 344 may be an electromechanical switch. When the flow switch 344 reaches the upper end 330 of the inner casing 316, the flow switch may trigger an electromechanical valve that will shut divert flow from the mud motor to the annulus 334.

Figures 1, 4:
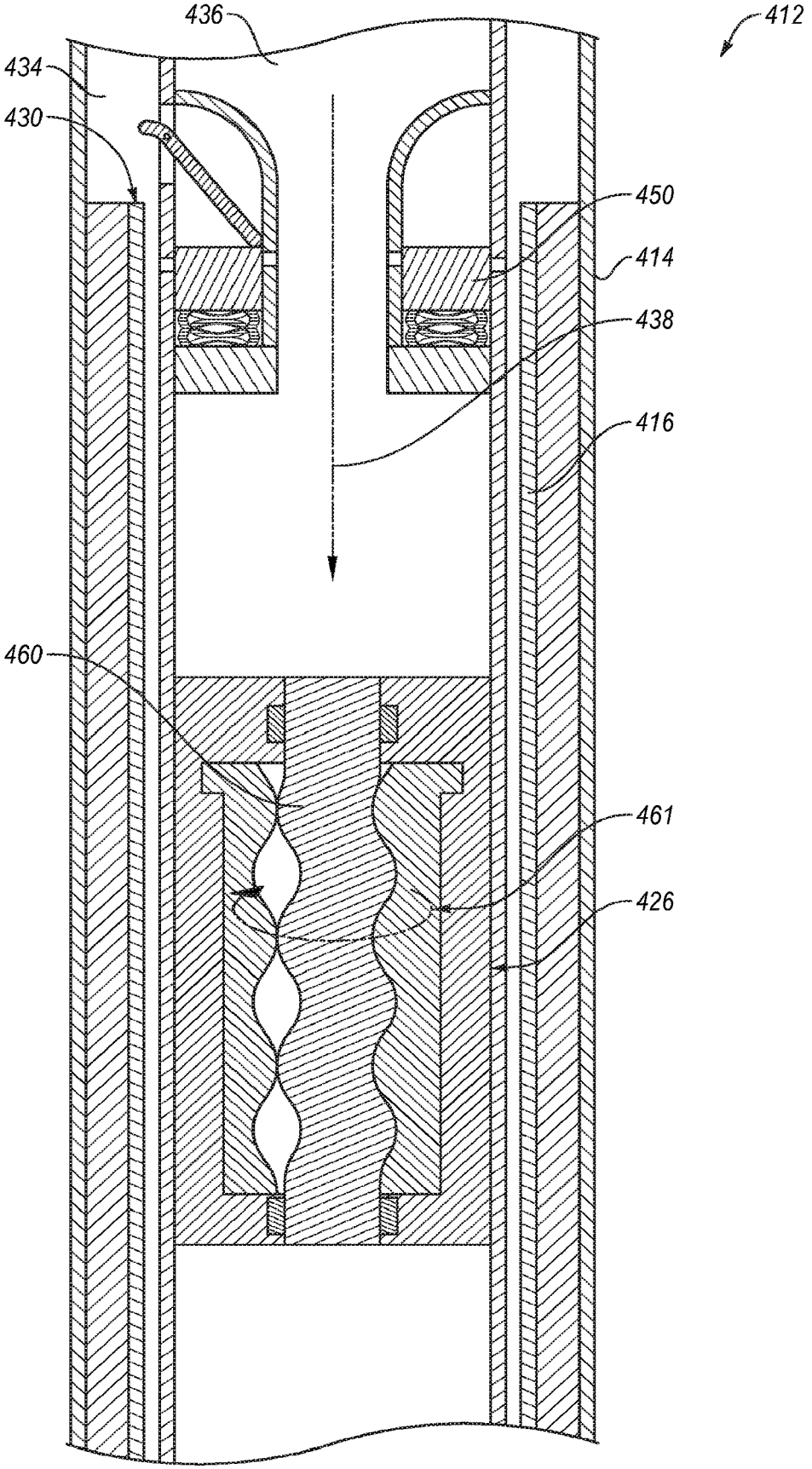
Figures 2, 4:
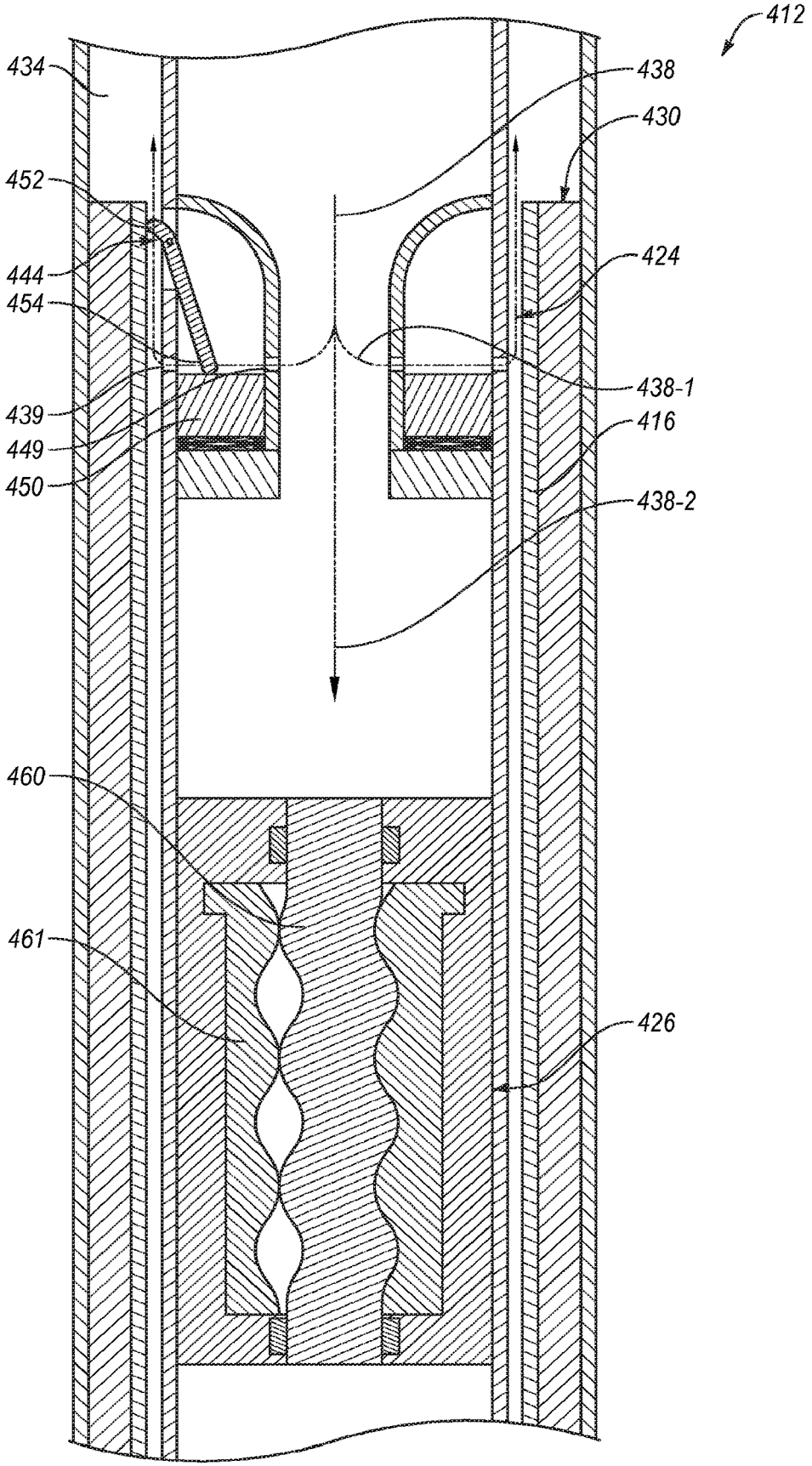

FIG. 4-1 is a representation of a portion of a casing removal system 412, according to at least one embodiment of the present disclosure. The casing removal system 412 includes a flow diversion valve 424 (such as the flow diversion valve 324 shown in FIG. 3-1 and FIG. 3-2) and a mud motor 426. In the position shown in FIG. 41, the flow diversion valve 424 is located in a closed position above the upper end 430 (e.g., the stump) of an inner casing 416, the inner casing 416 being located inside the outer casing 414. When located above the upper end 430, the flow diversion valve 424 is in the closed position, with the flow diverter 450 blocking flow from the central bore 436 to the annulus 434.

In the closed position, an entirety of, or a majority of, the fluid flow 438 flows through the central bore 436 and down to the mud motor 426. In some embodiments, the fluid flow 438 may be above a minimum fluid flow sufficient to operate the mud motor 426. For example, the mud motor 426 may be a progressive cavity motor having a rotor 460 that rotates (e.g., with a rotation 461) eccentrically inside a stator 462. The rotor 460 and the stator 462 may have one or more lobes, with the rotor 460 having one lobe less than the stator 462 such that as the fluid flow 438 flows through the mud motor 426, the fluid passes through the cavities formed between the rotor 460 and the stator 462. This rotation of the rotor 460 may be used to generate electrical or rotational power downhole of the mud motor 426. For example, the rotation of the rotor 460 may be used to provide the rotational energy for a casing cutter (e.g., casing cutter 228 of FIG. 2).

Thus, when the flow diversion valve 424 is located in the closed position, the fluid flow 438 may flow through the central bore 436 to the mud motor 426. When the fluid flow 438 is above a minimum fluid flow, the fluid flow 438 may drive the mud motor 426. This may allow the mud motor 426 to operate while the flow diversion valve 424 is in the closed position. For example, the mud motor 426 may be used to drive a casing cutter used to cut a section of the inner casing 416.

FIG. 4-2 is a representation of the portion of the casing removal system 412 of FIG. 4-1 in an open position, according to at least one embodiment of the present disclosure. In the position shown, the flow diversion valve 424 has been lowered below is lowered below the upper end 430, the flow switch 444 engages the inner casing 416. Contact with the upper end 430 causes the outer portion 452 to rotate about the pin 456 (i.e., clockwise in the view shown). This causes the inner portion 454 to push the flow diverter 450 downward.

Pushing the flow diverter 450 downward may cause the sleeve port 449 and the housing port 439 to be uncovered. This may open a hydraulic pathway between the central bore 436 and the annulus 434. In other words, this may cause the fluid flow 438 to be short-circuited to the annulus 434 from the central bore 436. For example, at least a first portion 438-1 of the fluid flow 438 may pass through the sleeve port 449 and the housing port 439 to the annulus 434.

In some embodiments, the first portion 438-1 may be an entirety of the fluid flow 438. In other words, an entirety of the fluid flow 438 may pass from the central bore 436 to the annulus 434. In some embodiments, the first portion 438-1 may be less than an entirety of the fluid flow 438, and a second portion 438-2 may flow through the central bore 436 to the mud motor 426. In some embodiments, the first portion 438-1 and the second portion 438-2 may have the same volumetric (e.g., mass) flow rate. In some embodiments, the first portion 438-1 may have a higher volumetric flow rate than the second portion 438-2. In some embodiments, the first portion 438-1 may have a lower volumetric flow rate than the second portion 438-2.

The second portion 438-2 may have flow rate that is less than the minimum flow rate sufficient to operate the mud motor 426. Thus, when the flow diversion valve 424 is open, or in the open position, the mud motor 426 may not operate (e.g., the rotor 460 may not rotate, or the mud motor 426 may stall). In this manner, the mud motor 426 may be shut off while still pumping drilling mud through the central bore 436. Cycling the mud motor 426 off may allow other downhole tools to be operated independent of the mud motor 426. For example, the casing removal system 412 may be used to cycle between pulling on the inner casing 416 and cutting a portion of the inner casing 416 with a casing cutter. This may allow a portion of the inner casing 416 to be removed in a single trip, thereby saving time and money.

Figures 1, 5:
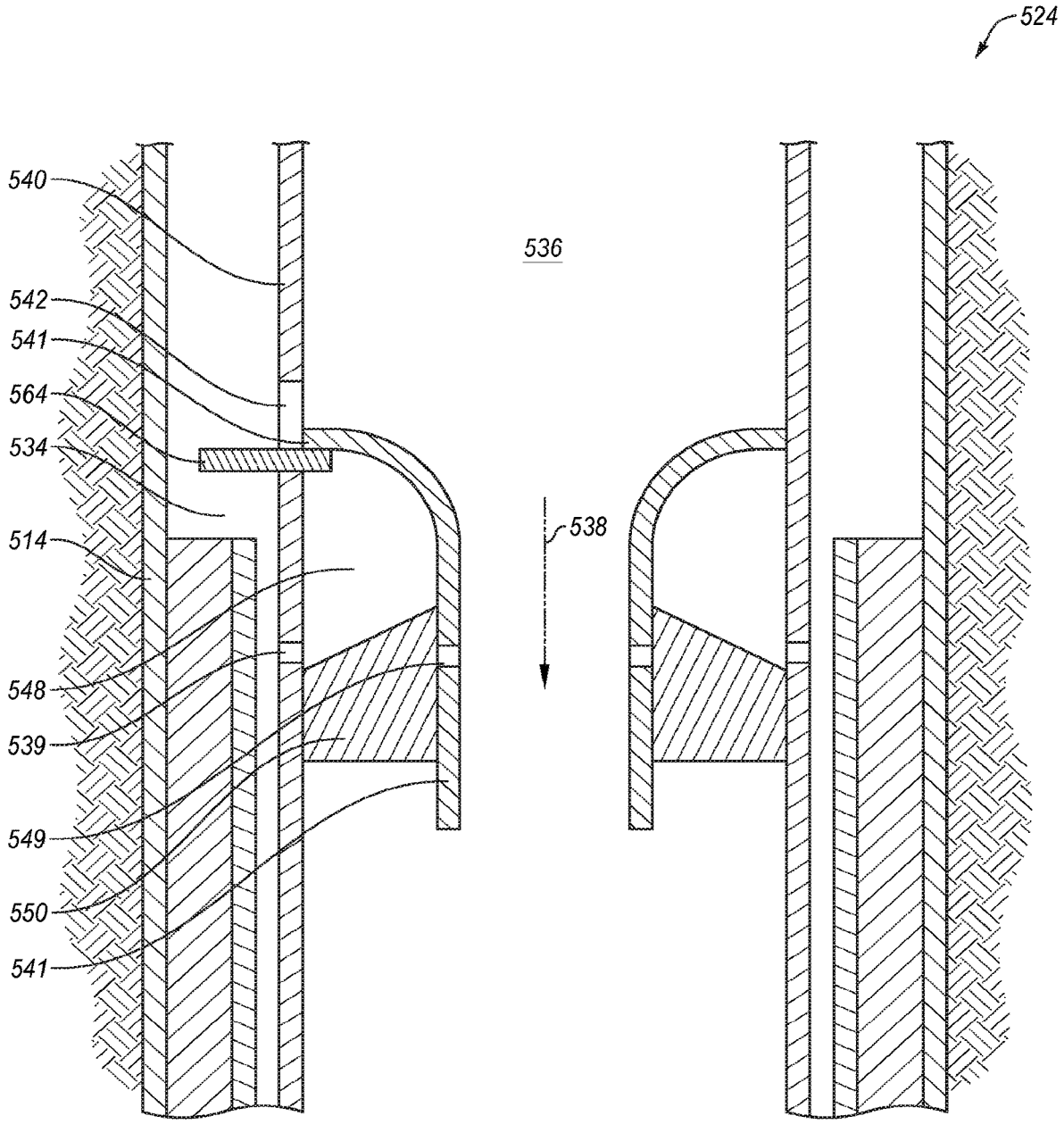
Figures 2, 5:
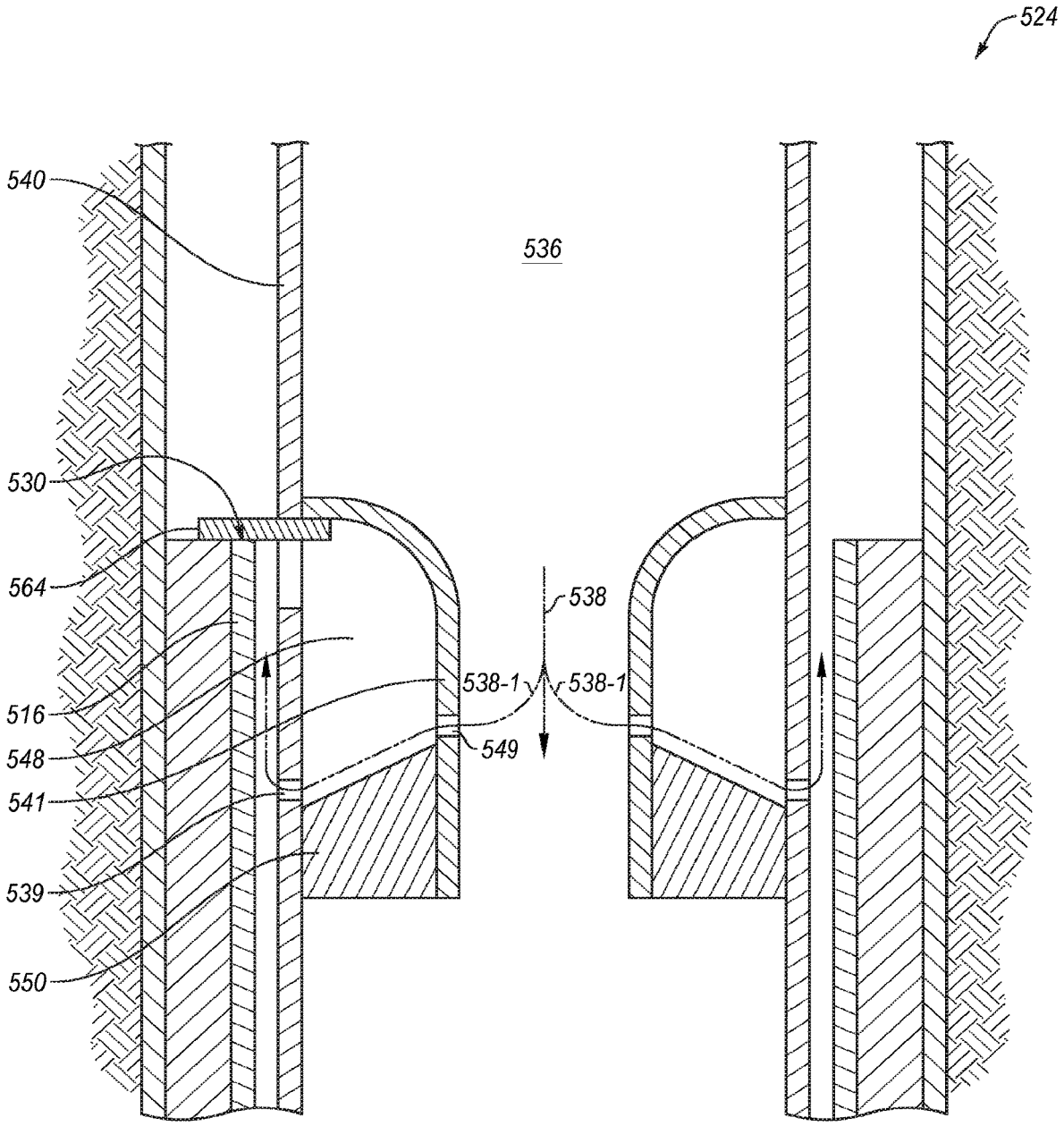

FIG. 5-1 is a representation of a flow diversion valve 524, according to at least one embodiment of the present disclosure. The flow diversion valve 524 includes an opening 542 in a housing 540. A stop plate 564 extends through the opening 542 and into an annulus 534 between the housing 540 and an outer casing 514. The stop plate 564 extends into a valve chamber 548 and contacts a bottom of a sleeve 541. The sleeve 541 extends into the central bore 536 and down past a flow diverter 550. In the closed position shown, a sleeve port 549 in the sleeve 541 is obstructed by the flow diverter 550. A housing port 539 is open to the annulus 534 and the valve chamber 548. In this manner, in the open position or the closed position, a fluid flow 538 through the central bore 536 may pass by the sleeve port 549 and travel down to the mud motor.

FIG. 5-2 is a representation of the flow diversion valve 524 of FIG. 5-1 in the open position, according to at least one embodiment of the present disclosure. In the position shown, the housing 540 has been lowered until the stop plate 564 contacts an upper edge 530 of the inner casing 516. As the housing 540 is further lowered, the sleeve 541 slides uphole relative to the housing 540 and the flow diverter 544. In the embodiment shown, the flow diverter 544 is fixed to or fixed relative to the housing 540. As the sleeve 541 slides uphole, the sleeve port 549 may become uncovered or exposed by the flow diverter 544.

Uncovering the sleeve port 549 may open the flow diversion valve 524. This may cause at least a portion 538-1 of the fluid flow 538 to flow through the sleeve port 549, into the valve chamber 548 and into the annulus 534 through the housing port 539. Thus, in the lower or the open position, the flow diversion valve 524 may create a hydraulic short-circuit for the fluid flow 538 to flow through from the central bore 536. In some embodiments, the portion 538-1 may include a majority of the fluid flow 538. In some embodiments, the portion 538-1 may divert sufficient fluid flow such that a mud motor below the flow diversion valve 524 does not have sufficient fluid flow to operate. In this manner, by opening the flow diversion valve, a hydraulically operated downhole tool (such as the jack 220 of FIG. 2) may operate independently of, or non-simultaneously with, the mud motor. This may allow the jack to pull on the inner casing 516 a first time, the mud motor to turn a casing cutter and cut a section of the inner casing 516, and the jack to pull on the inner casing 516 a second time in the same trip downhole. This may save time and money by limiting the number of trips in and out of downhole.

Figures 1, 6:
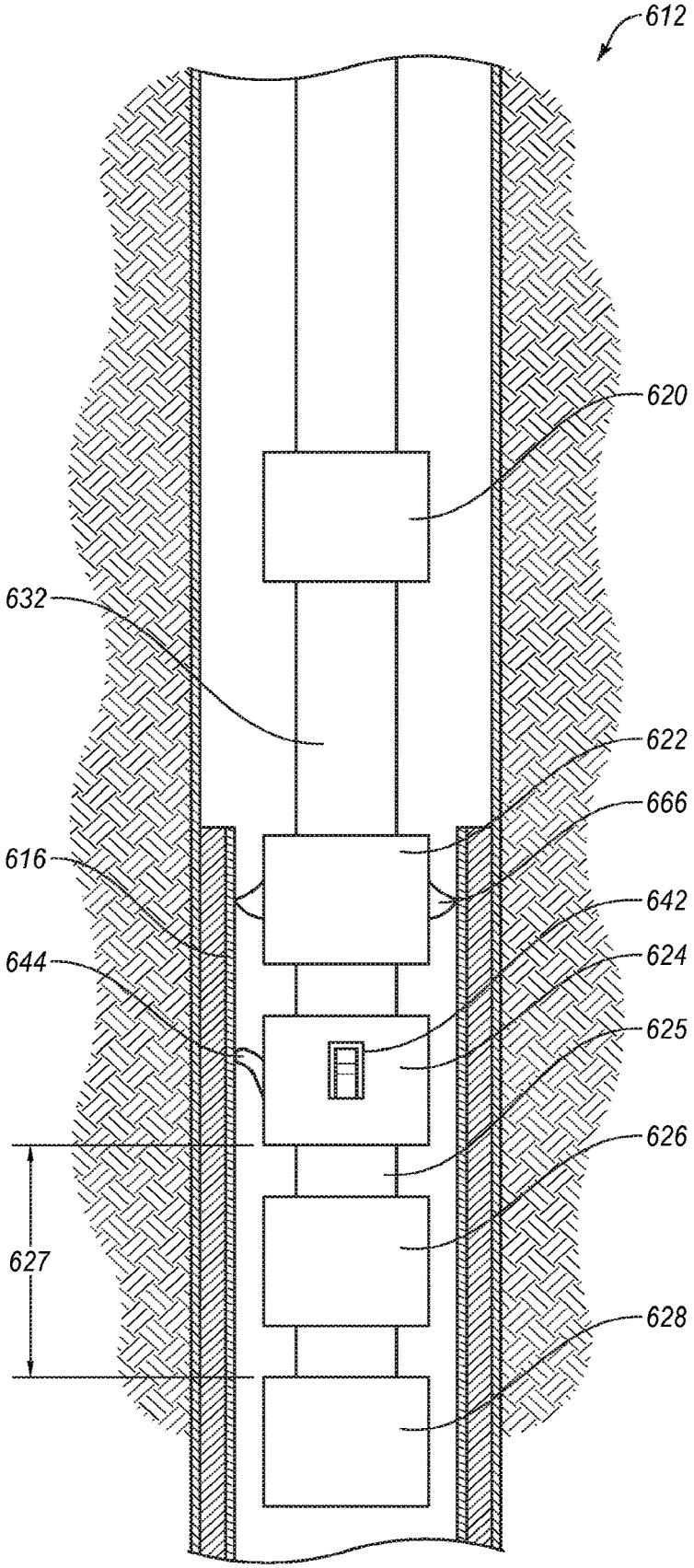
Figures 2, 6:
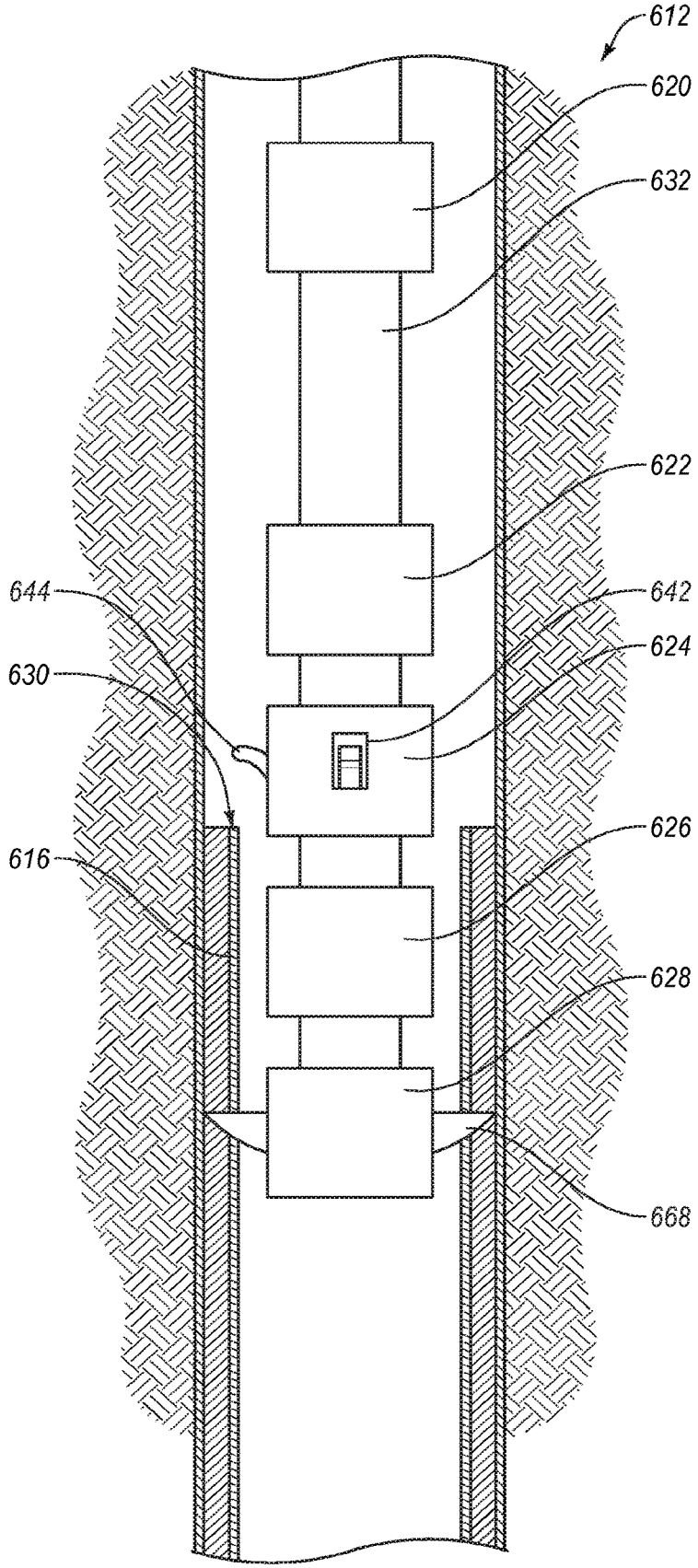
Figures 3, 6:
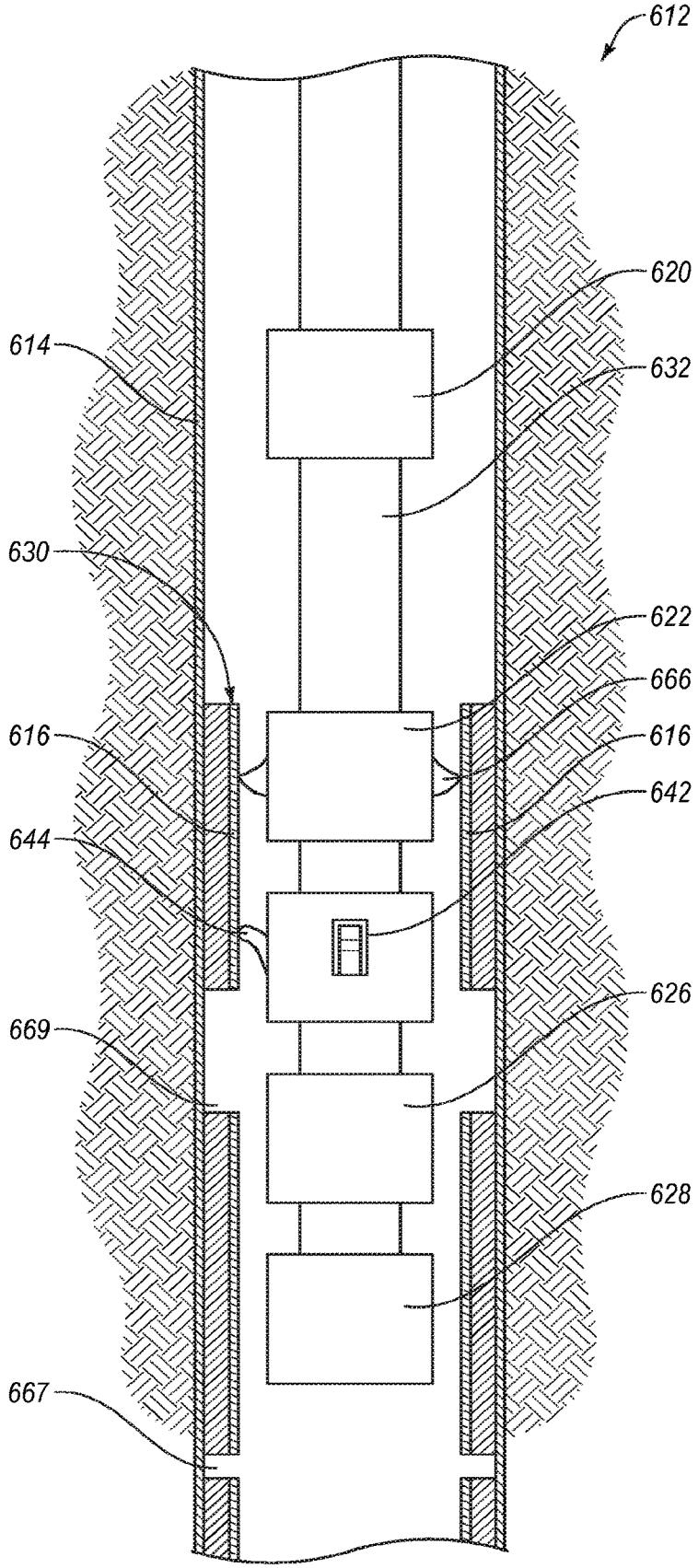

FIG. 6-1 is a representation of a casing removal system 612 in a lowered position, according to at least one embodiment of the present disclosure. The casing removal system 612 includes a jack 620, a spear 622, a flow diversion valve 624, a mud motor 626, and a casing cutter 628. In the position shown, the casing removal system 612 has been lowered until the spear 622 is lowered below the upper end 630 (e.g., the stump) of the inner casing 616. The spear 622 extends grips 666 radially outward, which contact the inner casing 616. The jack 620 may then exert an upward force on the tubular members 632 connecting the spear 622 to the jack 620. In some embodiments, the jack 620 may engage the outer casing while exerting the upward force on the tubular members 632. This may allow the jack 620 to increase the force exerted on the tubular members 632.

In the position shown, the flow diversion valve 624 is located below the upper end 630 of the inner casing 616. Therefore, in the position shown in FIG. 6-1, the flow switches 644 through the openings 642 are in the open position, and the flow diversion valve 624 is open, and a fluid flow does not flow to the mud motor 626 with sufficient flow to operate the mud motor 626. Thus, despite hydraulic activation of the jack 620, the mud motor 626 does not provide power to the casing cutter 628.

In some embodiments, the jack 620 may not be able to remove the inner casing 616. Therefore, the inner casing 616 may be cut with a casing cutter 628 to reduce the size of the inner casing 616 to be removed. Conventionally, to cut the inner casing 616, the casing removal system 612 is tripped to the surface, the jack 620 is removed from the drill string, and a separate milling system is installed, lowered into the wellbore, and cuts the inner casing 616. Then, the milling system is tripped to the surface, removed, and the jack 620 is reinstalled on the drill string and lowered back into the hole to attempt to remove the inner casing. This is time consuming and expensive.

FIG. 6-2 illustrates the casing removal system 612 in a closed position, according to at least one embodiment of the present disclosure. In the position shown, the casing removal system 612 is raised until the flow diversion valve 624 is above the upper end 630 of the inner casing 616, thereby placing the flow switches 644 through the openings 642 into the closed position. This closes the flow diversion valve 624, which allows the fluid flow to flow through the casing removal system 612 to the mud motor 626. The mud motor 626 may then drive the casing cutter 628, which cuts a portion of the inner casing 616 with one or more expandable reamers 668. By including the flow diversion valve 624, the casing cutter 628 may be located on the same drill string as the jack 620. This may save two or more complete trips (i.e., one to remove the jack 620 and install the casing cutter 628, and one to remove the casing cutter 628 and install the jack 620) out of and back into the wellbore. This saves considerable time, and therefore money, in a drilling operation.

FIG. 6-3 illustrates the casing removal system 612 in a lowered position after the inner casing 616 has been cut by the casing cutter 628, according to at least one embodiment of the present disclosure. In the embodiment shown, the flow diversion valve is below the upper end 630 of the inner casing 616. The spear 622 has extended the grips 666 to the inner casing 616. The jack 620 has pulled on the connecting tubular member 632 sufficient to break the inner casing 616 free from the outer casing 614. At this point, the casing removal system 612 may be tripped up to the surface, and the inner casing 616 removed from the wellbore.

It should be understood that the process described in reference to FIG. 6-1 through FIG. 6-3 may be repeated indefinitely until the inner casing is removed. Specifically, the inner casing 616 may be cut into smaller and smaller lengths if the jack 620 remains unable to break the inner casing 616 free from the outer casing 614. For example, the casing cutter 628 may cut a first cut 667 at a first borehole depth. If the jack 620 is unable to remove the inner casing 616, then the casing cutter 628 may make a second cut 669 at a second borehole depth uphole of the first borehole depth. In the embodiment shown in FIG. 6-3, the jack 620 was able to remove the inner casing 616 after the second cut 669. However, it should be understood that the casing cutter 628 may make any number of cuts to the inner casing 616 until the jack 620 can remove the cut section of the inner casing. This is because the flow diversion valve 624 resets between positions (e.g., the closed position shown in FIG. 3-1 and the open position shown in FIG. 3-2). Thus, no matter how many times the inner casing 616 is cut, the casing removal system 612 may remain downhole until the inner casing 616 is removed.

In some embodiments, a connector 625 between the flow diversion valve 624 and the mud motor 626 and/or between the mud motor 626 and the casing cutter 628 may extend a length 627 between the flow diversion valve 624 and the casing cutter 628. This may allow the casing removal system 612 to remove greater lengths of the inner casing 616. Removing greater lengths of the inner casing 616 may reduce the total number of trips used to remove a desired length of the inner casing 616.

It should further be understood that the process described in reference to FIG. 6-1 through FIG. 6-3 may begin at any point described herein. For example, a drill operator may desire to cut a portion of the inner casing 616 before attempting to remove the inner casing 616. Therefore, the casing removal system 612 may first be lowered into the closed position shown in FIG. 6-2 and the inner casing 616 cut with the casing cutter 628 without attempting to removing the inner casing 616 first. Similarly, the casing removal system 612 may successfully dislodge and remove the inner casing 616 on the first attempt (e.g., the step shown in FIG. 6-3), without cutting the inner casing 616. Nevertheless, the casing removal system 612 of the present disclosure allows for the process to begin at any of the points shown, and to cycle through each of the positions or steps shown until the inner casing 616 is dislodged from the outer casing 614.

Figure 7:
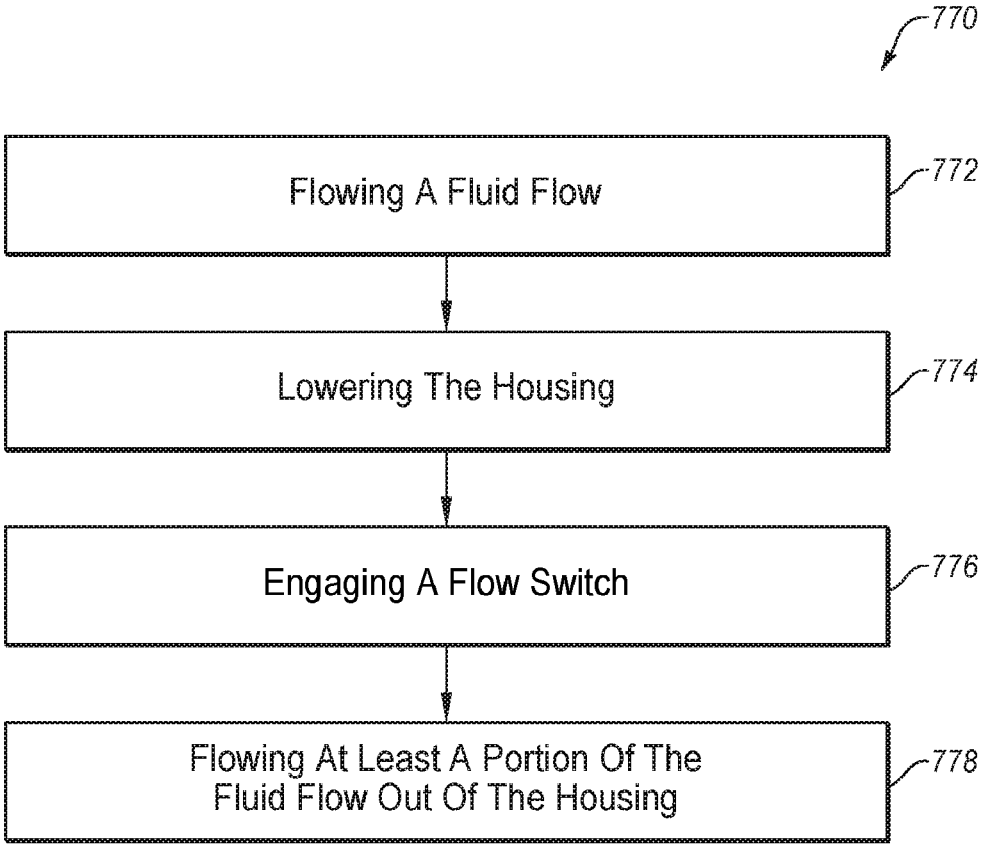
FIG. 7 is a representation of a method using an embodiment of the flow diversion valve.

FIG. 7 is a representation of a method 770 for removing an inner casing internal to an outer casing, according to at least one embodiment of the present disclosure. The method 770 includes flowing a fluid flow axially through a flow diversion valve in a housing at 772. The fluid flow has a first flow rate below the flow diversion valve. The method 770 may include operating a mud motor below the flow diversion valve. The mud motor may be operated in response to, or based on, the first flow rate. The mud motor may rotate a casing cutter to cut a portion of an inner casing.

The method 770 includes lowering the housing through the outer casing to an inner casing at 774. A flow switch on the flow diversion valve is engaged on an upper surface (e.g., a stump) and/or inner surface of the inner casing at 776. The flow switch extends from inside the housing to outside the housing. Engaging the flow switch includes moving a flow diverter, the flow diverter opens a housing port in the housing.

The method 770 further includes flowing at least a portion of the fluid flow through the housing port at 778. A second flow rate flows below the diversion valve. The mud motor is not operable at the second flow rate. In other words, opening the flow diversion valve stops operation of the mud motor.

The method 770 may further include raising the housing above the inner casing and disengaging the flow switch from the upper surface of the inner casing. Disengaging the flow switch may result in the fluid flow returning to the first flow rate below the flow diversion valve.

Figure 8:
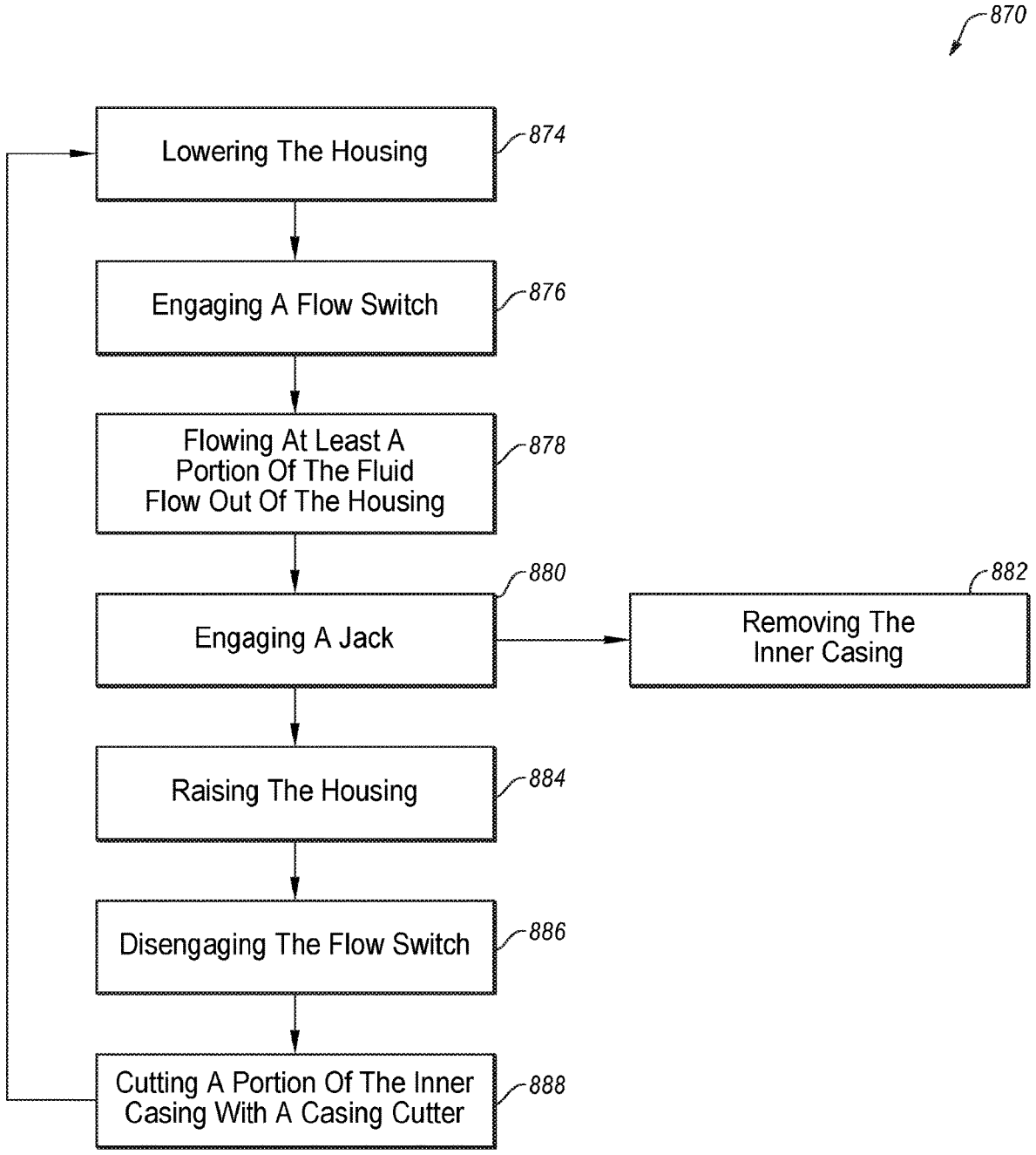
FIG. 8 is a representation of a method for removing a casing, according to at least one embodiment of the present disclosure.

FIG. 8 is a representation of an embodiment of a method 870 for removing an inner casing internal to an outer casing, according to at least one embodiment of the present disclosure. The method 870 may include lowering a flow diversion valve to the depth of and/or below an upper surface (e.g., a stump) of the inner casing at 874. This may cause a flow switch to be engaged on the upper surface and/or the inner surface of the inner casing at 876. Engaging the flow switch on the inner casing may hydraulically open a flow path between the interior of the housing and the annulus of the wellbore. In this manner, at least a portion of the fluid flow may flow from the interior of the housing to the exterior of the housing. In this position, the fluid flow below the flow diversion valve may be insufficient to operate a mud motor (and therefore the casing cutter) downhole of the flow diversion valve, or below the level sufficient to operate the mud motor (and therefore the casing cutter).

The method 870 may include engaging a jack to attempt to dislodge or dislocate a portion or all of the inner casing at 880. If the jack successfully dislodges the inner casing, then the inner casing is removed at 882. If the jack is unable to dislodge the inner casing, then the housing of the flow diverter valve may be raised above the upper surface of the inner casing at 884. This may cause the flow switch to be disengaged from the inner casing at 886. Disengaging the flow switch may cause the flow path between the interior of the housing and the annulus of the wellbore to be closed. This may prevent the portion of the fluid flow from flowing to the annulus, and therefore increase the fluid flow below the flow diversion valve. The fluid flow below the flow diversion valve may then be sufficient to operate the mud motor. The mud motor may drive a casing cutter, which may cut a portion of the inner casing at 888.

The method 870 may then be repeated until the jack successfully dislodges the inner casing and the portion of the inner casing can be removed from the wellbore at 882. The method 870 may be repeated indefinitely until a small enough length of the inner casing is cut that the section may be removed.

Figures 1, 9:
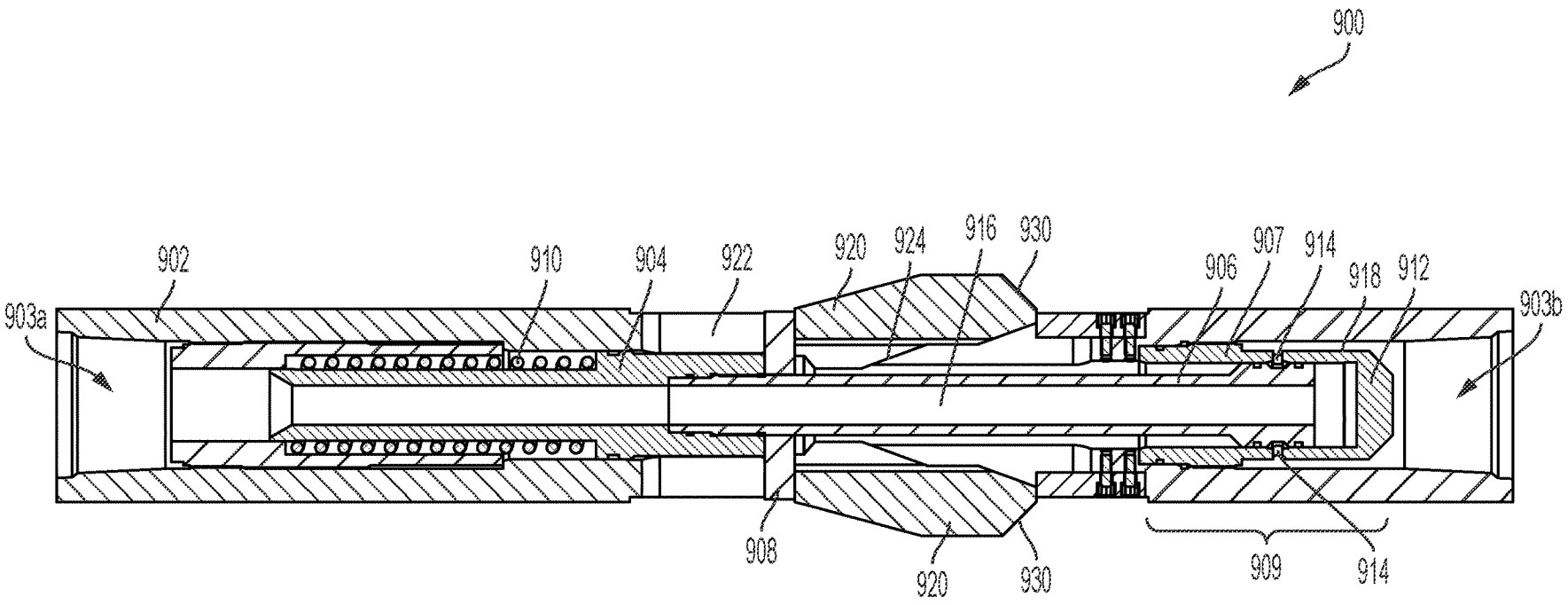
Figures 2, 9:
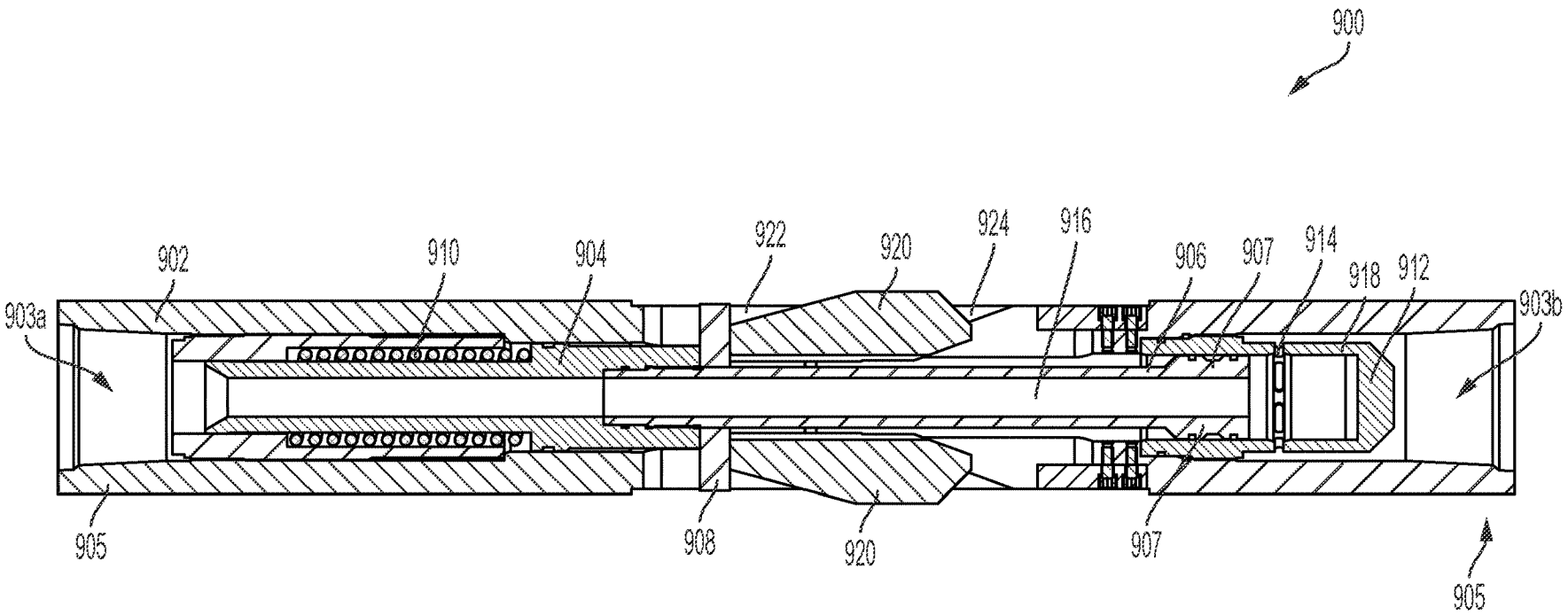
Figures 3, 9:
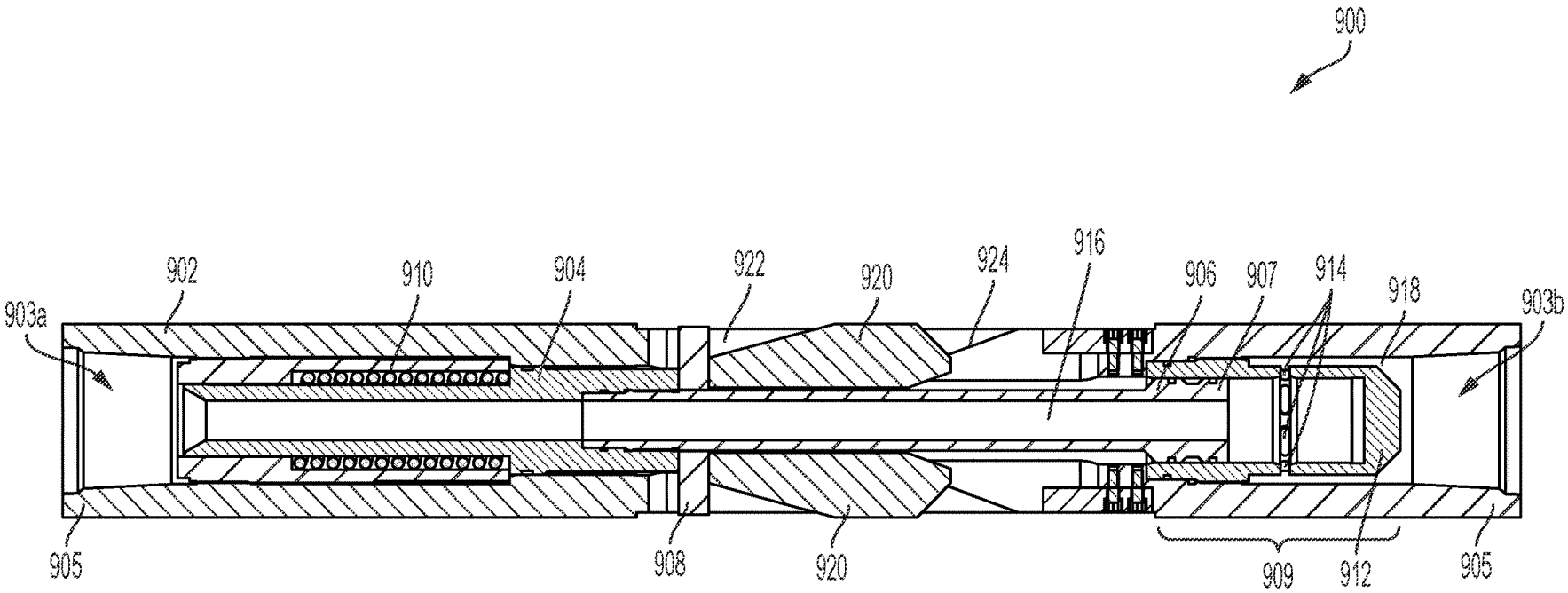

Referring now to FIGS. 9-1 to 9-3, flow diversion valve 900 which is a representative, non-limiting example of a second embodiment of flow diversion valve that may be substituted for the flow diversion valve in the assemblies disclosed above or as part of other bottom hole assemblies to control the flow of fluid through a downhole assembly in response to a change in a change in the inner diameter of a casing or pipe string through which it is being lowered or raised. The flow diversion valve includes laterally extending control members that actuate the valve when displaced radially with respect to the valve body. The control members may assume two or more positions. Optionally, the control members may assume three or more positions: a fully extended in position in which the valve is in first control state; at least one intermediate partially extending or partially displaced position in which the valve is in a second fluid control state; and a third, fully retracted position in which the valve is in the second fluid control state, optionally, in a the fluid control state. In the example in FIGS. 9-1 to 9-3, the control members, implemented using blocks 920, are shown in three positions: a first position, illustrated by FIG. 9-1, in which the control members are fully extended and the fluid diversion valve 900 is in a first fluid control state; a second or intermediate position, shown by FIG. 9-2, in which the fluid diversion valve 900 is in a second fluid control state; and a third position, shown in FIG. 9-3, in which the fluid diversion valve remains in the second fluid control state.

When flow diverter valve 900 is in the first fluid control position, fluid flow through a downhole tool assembly is restricted (meaning reduced as compared to the second fluid control position or an "open" or partially open position) or stopped (meaning no flow or an insubstantial flow rate to allow for an amount of leakage for the given application) in a downhole direction past flow diversion valve 900 to one or more components in the assembly below the valve. The first fluid control position may also be referred to a "closed" position.

Examples components in the assembly include those that use fluid pressure to operate, such as a positive displacement or "mud" motor, a tool with hydraulically extended or set slips, such as a spear or anchor, and a cutter. However, a component located below the valve need not be powered by the fluid. Such a component might use or control the fluid for some other purpose.

In the second fluid control position, the flow diversion valve allows for a greater rate of flow of fluid through the flow diversion valve as compared to the first control position. The cross-sectional area for fluid to flow through the tool in the first control position is lower than that of the second fluid control state.

The flow diverter valve 900 is comprised of body 902 with an opening 903*a* at an upper end, through which fluid is received and an opening 903*b* at a lower end, through which fluid may exit. Defining each opening is, optionally, a connector 905 for connecting the valve with other tools or components of a downhole assembly. Running through the center of the body 902 is a hollow fluid flow pathway defined by, in this example, a mandrel assembling comprising an upper mandrel 904 and a lower mandrel 906. The upper mandrel 904 is configured to couple with uphole end of lower mandrel 906 to form a fluid-right connection. A single mandrel or an assembly of three or more mandrels could be substituted. "Mandrel assembly" therefore may refer to a single mandrel unless otherwise noted.

A ring 908, called herein a drive ring, is coupled to lower mandrel 906: axial movement of ring 908 along the longitudinal or center axis of body 902 results in the corresponding axial movement of lower mandrel 906 and vice versa. Other structures can be substituted for the drive ring that do not fully encircle the lower mandrel.

The mandrel assembly and drive ring 908 are, as a unit, axially biased in the downhole direction by compression spring 910. Since the downhole end of upper mandrel contacts and mates with the uphole face of drive ring 908 and the uphole end of lower mandrel 906, drive ring 908 and lower mandrel 906 are also axially biased in the downhole direction by compression spring 910.

Fluid flow through flow diversion valve 900, and in particular along the flow path defined by the hollow cores of the mandrel assembly, is controlled by an internal valve 909 at the lower end of the flow diversion valve 900. The internal valve 909 comprises a valve housing 912 that remains stationary with respect to the body 902 and cooperates with the lower mandrel 906 to open and closed flow openings 914 in the valve housing. In this embodiment, the downhole end of lower mandrel 906 is disposed within valve housing 912. The mandrel assembly shifts axially between a first position in which valve seat 907, which in this example is formed from the lower end of mandrel 906 to overs or blocks fluid flow openings 914, and one or more open positions. Two positions of the mandrel 906 and valve seat 907 are shown in FIGS. 9-2 and 9-3, respectively, each corresponding to an open or second fluid control state in which the fluid flow openings 914 through the valve housing 912 are unblocked, allow fluid to flow through a central fluid pathway 916 formed, collectively, upper mandrel 904, lower mandrel 906, and valve housing 912. The central fluid pathway 916 allows for fluid flowing into the uphole end of flow diverter valve 900 to flow to valve housing 912 and then, depending on whether they valve seat 907 blocks flow openings 914, into flow pathway 918. Flow pathway 918 is defined by space between the outer surface of valve housing 912 and the inner wall of body 902 and is in fluid communication with the downhole end of body 902.

Flow diversion valve 900 also comprises control members for actuating the valve assembly comprised of blocks 920. Blocks 920 are configured to fit within openings 922 of body 902. Each of the blocks 920 and the body have complementary key and keyways that cooperate to constrain movement of the block with respect to the body 902. The key and keyways are angled with respect to the axis so that the blocks are forced to translate along a ramp 924 that results in relative displacement of each block in both a radial and axial direction. Axial displacement of block 920 in the uphole direction results in inward radial displacement of block 920. An uphole end of block 920 is adapted or configured to engage a downhole face of drive ring 908.

Relative axial movement of a block to the body in the uphole direction therefore displaces the drive ring 908 relative to the body, against the biasing force of compression spring 910, resulting in the mandrel assembly shifting relative to the body and opening the valve assembly. This can be seen by comparing FIGS. 9-1, 9-2 and 9-3. At the same time, the block translates radially inwardly, to reduce the overall diameter of the flow diversion valve 900, allowing it to fit within a narrower diameter casing. Without a sufficient axial or radial force applied to the blocks 902, the force biasing spring 910 will push in the axial direction against the blocks 920, causing them to translate both axially (in the downhole direction) and radially outwardly relative to the body 902.

In FIG. 9-1, flow diversion valve 900 is in the closed position, which in this embodiment, prevents flow of fluid to components that are downhole of diversion valve 900. In the closed position as shown, compression spring 910 biases upper mandrel 904 in the downhole direction. The engagement of upper mandrel 904 biases lower mandrel 906 axially in the downhole direction. This results in the downhole end of lower mandrel 906, which is disposed within valve housing 912 to cover flow openings 914 of valve housing 912. Thereby preventing further flow of fluids out of valve housing 912 in the downhole direction. The biasing of upper mandrel 904 and lower mandrel 906 by compressed biasing spring 910 also results in drive ring 908 being axially biased in the downhole direction. This in turn pushes blocks 920 axially in a downhole direction. The engagement of block 920 with ramp 924 results in the outward radial displacement of blocks 920. Therefore, when flow divertor valve 900 is in the closed position, blocks 920 are extended radially in an outward direction from the outer surface of body 902.

When flow diversion valve 900 is in the closed position, which is an example of a first fluid control position, fluid flow through central bore 916 is substantially blocked. This substantially complete blockage of flow provides an advantage of being able to substantially pressurize fluid being pumping through the string to the tools in the downhole assembly above flow diversion valve 900. This advantage is useful for operating jacks, such as jack 220 of FIG. 2, or other tools requiring high pressure and low flow rates for operation. Increased fluid pressure increases the force which jack 220 can place on casing during a casing pulling operation. However, when the flow diversion valve 900 is an open position, higher flow rates of fluid are permitted to allow for operation of a tool in the assembly below the flow diversion valve, such as a mud motor and/or cutter as described herein.

As previously noted, the particular example of FIGS. 9-1 to 9-3 has the flow diversion valve 900 in an open state or position when the blocks 920 are in intermediate position and a fully retracted position, thereby allowing the same flow diversion valve to be opened when the flow diversion valve passes into casing having more than one diameter. Alternatively, the intermediate position of the blocks could be used to set the flow diversion valve into a third fluid control state having, in which the flow rate is different from the flow rate in the second fluid control state This could be done, for example, by placing a second set of fluid flow openings in the valve body that are blocked or unblocked depending on the position of the valve seat 907.

Blocks 920 of flow diversion valve 900 are configured so that, when the blacks are not displaced when in a larger diameter casing but are actuated or displaced when being pushed into a casing with a small inner diameter. For example, it is common to line a wellbore with 133/8 inch casing on the uphole end to a certain depth. Below this, the next step down in casing, 95/8 inch casing, is hung off of the 133/8 inch casing and continues downhole. An operator, at some point, may want to pull the 95/8 inch casing from the wellbore, as described herein using the apparatus described herein. In this case, the flow diversion valve 900 can be configured so that, when flow diversion valve 900 is inside the larger 133/8 inch, casing blocks 920 are fully extended and are not compressed inwardly by the inner wall of the 133/8 inch casing by are inwardly disclosed, and when the flow diversion valve is inside the smaller 95/8 inch diameter, the casing blocks 920 are displaced inwardly by in the inner wall of the 95/8 inch casing. As flow diversion valve 900 moves from the 133/8 inch casing to the 95/8 inch casing, blocks 920 As flow diverter valve is lowered downhole into casing of a smaller diameter, an angled leading edge 930 on each of the lower edges of blocks 920 engages with the transition, causing displacement of the blocks in both an axial direction (parallel to a central axis of the body 902) and radial direction (along a radial to the central axis) relative to the body 902 of the flow diversion valve, which results in the switching of flow diversion flow 900 from the first fluid flow control state to the second fluid flow control state, allowing increased fluid flow rates through the flow diversion valve and the assembly in which it is used.

For example, when a flow divertor valve 900 configured as shown in FIGS. 9-1 to 9-3 is inserted into casings with an inner diameter too large to compress blocks 920, flow of fluid through fluid diversion valve 900 will be blocked. Blocks 920 of flow diversion valve will be, at this point, partially inwardly displaced, as shown in FIG. 9-2, meaning that they may be further inwardly displaced until in a fully retracted position shown in FIG. 9-3. Once the blocks move to a partially displaced or intermediate position, the internal valve is fully open and remains open, which allows the flow diversion valve to be actuated by insertion into casings with different inner diameters. Further shifting of the mandrel assembly does not increase the flow area of the ports or openings 914 in the valve assembly, and thus the fluid flow rate through the tool remains the same regardless of the inner diameter of the inner casing that actuates it, as long as it is larger than the outer diameter of the body 902 and small enough to partially displace the blocks 902 to the point that the internal valve opens or other otherwise increases the size of the fluid path existing the flow diversion valve to allow for sufficient fluid flow to operate the one or more tools placed below the flow diversion valve in the assembly In an alternative embodiment, flow diversion valve 900 can be configured so that 1) block 920 does not engage the inner wall of the largest diameter casing, so that block 920 is fully radially extend and flow diversion valve 900 is closed; 2) block 920 engages the inner wall of the casing with the middle diameter casing, so that block 920 is partially displaced and flow diversion valve 900 is closed; and 3) block 920 engages the inner wall of the casing with the smallest inner diameter, so that block 920 is sufficiently shifted radially inward and axially in the uphole direction so that flow diversion valve 900 is open. For example, shifting of the internal mandrel assembly by the blocks shifts the valve seat 907, but the shifting of the valve seat from its position when the blocks are in the fully extended position to which they are partially displaced does not, in contrast to the embodiment described above, shift the valve seat 907 far enough axially to uncover the ports or openings 907 in the valve body 912. The ports are uncovered only when the blocks are fully displaced.

Similarly, the valve seat 907 and ports 914 can be configured to allow different flow rates in each of the positions, including, for example, a higher flow rate in the intermediate position by, for example, using a set of ports or openings 914 with differently sized openings.

Flow diversion valve 900 may be used in a bottom hole assembly, such as casing removal system 212, to, in one trip, cut and pull inner casing from a wellbore, as described in relation to FIG. 2. In a representative example, and with reference to the casing removal system 212, the flow diversion valve 222 is replaced with a flow diversion valve 900 is substituted for bottom hole assembly is lowered into a wellbore having first casing 214 and second casing 216, the inner diameter of the first casing being greater than the inner diameter (and the outer diameter) of the second casing. An attempt to pull second casing 216 from the wellbore may be made without cutting second casing 216. In this case, jack 220 is anchored to first casing 214 and spear 222 is anchored to the second casing 216. Activation of jack 220 creates an upward force on second casing 216. If first casing 214 comes free, then it can be removed by pulling the bottom hole assembly from the wellbore.

If the second casing 216 is not pulled free, the second casing 216 can be cut to facilitate pulling second casing 216 from wellbore 202. In this case, jack 220 and spear 222 are unanchored from first casing 214 and second casing 216, respectively, and the casing removal system 212 is lowered so that flow diversion valve 900 is inserted into second casing 216. Insertion of flow diversion valve 900 into second casing 216 results in activation of the flow switching mechanism or means of flow diversion valve 900, as described herein, from the first fluid flow control state to the second fluid flow control state. When the flow diversion valve is in the second fluid flow control state, fluid being pumped from the surface through a work or drill string to which casing removal system 212 is attached will activate mud motor 226 which in turn activates cutter 216 and cuts second casing 216.

After cutting of second casing 216, casing removal system 212 is raised within the wellbore so that flow diversion valve 900 is removed from second casing 216. The removal of flow diversion valve 900 from second casing 216 results in flow diversion valve 900 switching to reduce or block fluid flow past the flow diversion valve to prevent operation of the tools in the downhole assembly below the flow diversion valve and/or enable greater fluid pressure to build in the downhole assembly above the flow diversion valve. Another attempt to pull second casing 216 using jack 220 and spear 222 may be made, as described above. This process is repeated until second casing 216 is pulled from wellbore 202.

This disclosure generally relates to devices, systems, and methods for removing a casing from a wellbore. The system includes a flow diversion valve. When the flow diversion valve is closed, a fluid flow may drive a mud motor, which powers a casing cutter. To open the flow diversion valve, the flow diversion valve is lowered below a stump of an inner casing. When the flow diversion valve is open, at least a portion of the fluid flow may be diverted to the annulus between the flow diversion valve and the casing. The portion of the fluid flow diverted to the annulus is such that, downhole of the flow diversion valve, the fluid flow is insufficient to drive the mud motor. Thus, when the flow diversion valve is open, a hydraulically powered jack may pull on a spear connected to the casing without driving the mud motor. Therefore, by raising and lowering the flow diversion valve above and below the stump of the inner casing, the casing removal system may cycle between pulling on the casing and driving a mud motor to operate a casing cutter. In contrast to conventional casing removal systems, which require a different trip into the wellbore for each step, in at least one implementation described herein, utilizing a flow diversion valve may allow pulling on the casing with a hydraulically powered jack and cutting of the casing with a casing cutter powered by a mud motor to occur in the same trip. This may reduce the number of trips in and out of the wellbore, thereby reducing the time and cost of removing the casing.

A casing removal system includes a plurality of downhole tools located inside the wellbore. The wellbore is lined with a first casing (e.g., an outer casing) and a second casing (e.g., an inner casing), the second casing being internal to the first casing. In some embodiments, the second casing may be connected to the first casing with a layer or a ring of material, such as cement, cementitious grout, chemical grout, concrete, or any other material used to connect the second casing to the first casing.

During operation of the casing removal system, a spear is lowered below an upper end of the second casing (e.g., at a stump, a shoulder, or a shelf of the second casing). The spear, located below a jack, may engage the second casing, and the jack may exert an upward force on a connecting tubular to try to dislodge the second casing. In some embodiments, the jack 220 may engage the first casing 214 while exerting the upward force on the connecting tubular 232. This may allow the jack 220 to increase the force exerted on the connecting tubular 232. If the second casing is not dislodged, then a portion of the second casing is cut with a casing cutter powered by a mud motor (e.g., a positive displacement motor, a progressive cavity motor, or a turbine generator). After the second casing is cut, the spear engages the second casing again, and the jack exerts an upward force on the second casing.

In some embodiments, the casing removal system may include one or more stabilizers, MWD, LWD, bit, RSS, any other portion of a BHA, and combinations of the foregoing. In some embodiments, the downhole tools in the casing removal system may be located in any order.

The jack and the mud motor (and therefore the casing cutter) may be hydraulically powered. To prevent undesirable milling of the second casing while applying force with the jack, the mud motor may be shut off when the flow diversion valve is below the upper end of the second casing. The flow diversion valve is actuated (e.g., opened) by lowering the flow diversion valve below the upper end of the second casing, which diverts flow out of a central bore of the casing removal system and into an annulus of the wellbore, thereby preventing an operating flow from reaching the mud motor. This may allow the casing removal system to cycle between operating the jack and operating the mud motor in the same trip downhole, thereby reducing the number of trips used to remove the second casing, which may save time and money.

A flow diversion valve includes a central bore through which a fluid flow flows. The central bore extends through a casing removal system from a jack to a casing cutter. The flow diversion valve includes a housing with an opening. The housing further includes a housing port through the housing below the opening.

The flow diversion valve includes a sleeve that extends from an inner surface of the housing into the central bore. The sleeve is connected to the inner surface of the housing above the opening, and extends into the central bore past the opening and the flow switch. In other words, the sleeve 341 may extend downhole from where it is attached to the inner surface 343 of the housing 340. The sleeve is supported on a downhole side by a sleeve support. The sleeve and the sleeve support form a valve chamber between the sleeve and the inner surface of the housing. The sleeve includes a sleeve port hydraulically connecting (e.g., in fluid communication with) the central bore to the valve chamber.

A flow diverter is located in the valve chamber and extends from the inner surface to the sleeve. In the closed position, the flow diverter may block some or all of the fluid flow from flowing from the central bore, through the sleeve port into the valve chamber, and from the valve chamber out of the housing port into the annulus. Thus, in the closed position, the fluid flow may flow through the flow diversion valve to the mud motor.

The flow diversion valve further includes a flow switch that extends through the opening into an annulus between the housing and the first casing and/or the second casing. The flow switch includes an outer portion (e.g., a first end) and an inner portion (e.g., a second end). The outer portion extends out of the housing through the opening. The inner portion extends through the opening into the valve chamber.

The flow switch pivots between a first switch position, and a second switch position. In some embodiments, for example, the pin may be connected to the housing at inner walls of the opening. For example, a pin 356 may extend across the opening 342 and through the flow switch 344. The flow switch 344 may be rotationally connected to the pin 356 such that the flow switch rotates relative to or about the pin 356. In some embodiments, the pin 356 may be rotationally fixed to the flow switch 344, and the pin 356 may be rotationally connected to the inner walls 357 of the opening 342. In some embodiments, the flow switch 344 may be rotationally connected to the opening 342 with a hinge, a bolt, a bearing, a shank, a rod, any other rotational connection, and combinations thereof.

In some embodiments, the pin may be connected to the housing with a bracket or an axle that is offset to the inside or the outside of the opening. In this manner, the rotational axis of the flow switch may be located in an optimized position. For example, by locating the pin inside the valve chamber, the inner portion of the flow switch may rotate closer to the inner surface of the housing.

The inner portion of the flow switch is configured to engage with an upper surface of the flow diverter. As the flow switch rotates, the inner portion pushes the flow diverter downward until a hydraulic pathway is opened between the central bore 336 and the annulus 334. Thus, in a first flow diverter position, fluid communication between the central bore 336 and the annulus 334 is reduced or eliminated by the flow diverter 350. In a second flow diverter position, fluid communication between the central bore 336 and the annulus 334 is opened. In other words, fluid communication between the central bore 336 and the annulus 334 is opened when the flow diverter moves between the first diverter position and the second diverter position For example, the flow diverter 350 may move downward until the sleeve port and the housing port are uncovered. Thus, the flow diverter is moved longitudinally in the housing, or parallel to a longitudinal axis of the flow diversion valve. The flow diverter is moved between a first diverter position (e.g., a closed diverter position) and a second diverter position (e.g., an open diverter position). Thus, the flow diversion valve is actuated by rotating the flow switch from the closed switch position to the open switch position, which pushes the flow diverter downward from the closed diverter position to the open diverter position. In some embodiments, the flow switch may include a torsion spring which rotates the flow switch such that the inner portion is in constant contact or is urged to be in constant contact with the upper surface of the flow diverter.

The upper surface may be perpendicular to the inner surface of the housing. In some embodiments, the upper surface may be oriented at an angle with respect to the inner surface of the housing. For example, an end of the upper surface next to the inner surface may be higher than an end of the upper surface near the sleeve. In other examples, the end of the upper surface next to the inner surface may be lower than the end of the upper surface near the sleeve. Changing the orientation of the upper surface may change how the upper surface moves with respect to a change in rotation of the flow switch. For example, an upper surface oriented with an inner surface end higher than the sleeve end may move longitudinally further. This may increase the sensitivity of the flow diversion valve, which may therefore utilize a smaller rotation of the flow switch to activate.

A resilient member urges the flow diverter upward, or toward the first diverter position. In this manner, the flow switch may overcome the upward force of the resilient member on the flow diverter to move the flow diverter from the closed position to the open position (e.g., to uncover the sleeve port and the housing port). The resilient member may be any resilient member, including one or more of disc spring, a Belleville washer, one or more coil springs, a wave spring, a hydraulic piston, or any other resilient member. In some embodiments, the resilient member may be supported by the sleeve support. In some embodiments, the resilient member may be supported by another support member or ring.

Thus, the flow diversion valve is normally closed absent a downward force on the flow diverter. In other words, the fluid flow is directed to the mud motor unless the flow diversion valve is opened. In this manner, the mud motor may be actuated simply by starting or resuming the fluid flow as long as the flow switch is in the closed position. This may be accomplished, for example, by starting the mud pumps on the surface.

In some embodiments, the flow diverter is an annular ring or disc that extends around an entirety of the inner surface of the housing. In some embodiments, the flow diverter may be broken up into a plurality of flow diverter sections. The flow diverter may include a single flow diverter section per flow switch. This may improve actuation of the flow diversion valve by reducing the mass of the flow diverter to be actuated.

To move from the closed position to the open position, the housing is moved downhole toward the upper end of the second casing (e.g., the stump of the inner casing). The outer portion of the flow switch extends past the outer surface of the housing with a distance that is greater than an inner annular gap between the outer surface and the second casing.

As the housing is lowered past the upper end of the second casing, the upper end and/or inner surface of the second casing 316 may push against the outer portion of the flow switch, thereby causing the flow switch to rotate about the pin from the first switch position (e.g., the closed switch position) to the second switch position (e.g., the open switch position). As the flow switch rotates about the pin, the inner portion pushes against the upper surface of the flow diverter. This may cause the flow diverter to move from the first diverter position (e.g., the closed diverter position) to the second diverter position (e.g., the open diverter position). In this manner, the flow diversion valve may move from the closed position to the open position.

As the flow diverter moves from the closed diverter position to the open diverter position, the sleeve port and the housing port may be uncovered. This may open a fluid path from the central bore to the annulus. In this manner, at least a portion, and possibly all, of the fluid flow may flow through the sleeve port into the valve chamber, and out of the valve chamber through the housing port into the annulus. Thus, by moving the flow diverter from the closed diverter position to the open diverter position, the flow diversion valve may divert some or all of the fluid flow to the annulus. The reduced fluid flow below the flow diversion valve may be insufficient to operate the mud motor. Therefore, when pumping fluid through the casing removal system, the fluid flow may be diverted to the annulus such that the mud motor does not rotate and the casing cutter does not cut a portion of the second casing. This may allow a hydraulically powered jack to operate independent of the mud motor. Operating the jack independently of the mud motor may allow casing removal system to perform a casing removal operation in a single downhole trip by allowing the casing removal system to sequence between pulling of the second casing by the jack and cutting of the second casing by the casing cutter. This may save the drilling operator time and money.

In some embodiments, the portion of the fluid flow flows to the annulus through the sleeve port and the housing port rather than down to the mud motor because flowing to the annulus through the valve chamber has a lower hydraulic resistance than flowing through the mud motor. Thus, when the flow diversion valve is opened, a hydraulic short-circuit is opened to the annulus from the central bore 336. In this manner, the flow diversion valve may divert flow away from the mud motor and to the annulus. Thus, the casing removal system may include independently operating hydraulic tools, such as the jack and the mud motor. This may allow two different hydraulically activated tools to be actuated based on the location of the downhole tool within the wellbore.

In some embodiments, moving the flow diverter downhole may uncover both the sleeve port and the housing port at the same time. In some embodiments, moving the flow diverter downhole may uncover the sleeve port before the housing port. This may allow the valve chamber to equalize pressure with the central bore before uncovering the housing port. In some embodiments, moving the flow diverter downhole may uncover the housing port before the sleeve port. This may allow the valve chamber to equalize pressure with the annulus before uncovering the sleeve port.

In some embodiments, the housing may include a plurality of openings with a plurality of flow switches extending through the openings and all exerting a force on the flow diverter. For example, the housing may include 2, 3, 4, 5, 6, 7, 8, 9, 10, 11, 12, or more openings and flow switches. In some embodiments, an opening may include more than one flow switch. For example, an opening may include 2, 3, 4, 5, 6, or more flow switches. In some embodiments, the openings and flow switches may be equally spaced around the outer circumference of the housing (i.e., spaced with equal radial distances between each opening and flow switch). In some embodiments, the openings and the flow switches may be unequally spaced around the outer circumference of the housing.

In some embodiments, the housing port may be aligned with (e.g., longitudinally aligned with) the opening. In some embodiments, the housing port may be unaligned with the opening. For example, the housing port may be longitudinally aligned with the opening. However, the housing port may not be longitudinally aligned with any opening.

In some embodiments, the housing may include the same number of housing ports as openings (i.e., a single housing port associated with a single opening). In some embodiments, the housing may include more housing ports than openings. In some embodiments, the housing may include more openings than housing ports. In some embodiments, the housing may not include any housing ports. For example, the portion of the fluid flow may flow out of the valve chamber through the opening.

The sleeve may include a plurality of sleeve ports. In some embodiments, the sleeve may include the same number of sleeve ports as the housing includes housing ports. In some embodiments, the sleeve may include more sleeve ports than housing ports. In some embodiments, the sleeve may include fewer sleeve ports than housing ports. In some embodiments the sleeve ports may be radially aligned with the housing ports (i.e., on the same radial path from the central bore out toward the housing). In some embodiments the sleeve ports may not be radially aligned with the housing ports.

By selecting the number, location, orientation, and placement of the sleeve ports and housing ports, the hydraulic pathway from the central bore to the annulus may be optimized. For example, an increase in the number of sleeve ports may decrease the velocity of the fluid flow entering the valve chamber. A decrease in the number of housing ports may increase the pressure differential between the central bore and the annulus, which may divert less of the fluid flow to the annulus. Aligning the sleeve ports with the housing ports may reduce the turbulence of the diverted fluid flow in the valve chamber, which may increase the flow from the central bore to the annulus. Thus, by changing the configuration of the sleeve ports and the housing ports, the hydraulic properties and pathway of the diverted portion of the fluid flow may be optimized.

In some embodiments, the housing ports and/or the sleeve ports may include a nozzle. The nozzle may be selected for a specific pressure drop between the central bore and the annulus. In this manner, the portion of the fluid flow that flows to the annulus in the open position may be controlled by controlling the diameter of the nozzle installed in the housing port and/or the sleeve port.

In some embodiments, the flow switch 344 may be an electromechanical switch. When the flow switch 344 reaches the upper end 330 of the inner casing 316, the flow switch may trigger an electromechanical valve that will shut divert flow from the mud motor to the annulus 334.

A casing removal system may include a flow diversion valve and a mud motor. The flow diversion valve may be located in a closed position above the upper end (e.g., the stump) of an inner casing, the inner casing being located inside the outer casing. When located above the upper end, the flow diversion valve is in the closed position, with the flow diverter blocking flow from the central bore to the annulus.

In the closed position, an entirety of, or a majority of, the fluid flow flows through the central bore and down to the mud motor. In some embodiments, the fluid flow may be above a minimum fluid flow sufficient to operate the mud motor. For example, the mud motor may be a progressive cavity motor having a rotor that rotates eccentrically inside a stator. The rotor and the stator may have one or more lobes, with the rotor having one lobe less than the stator such that as the fluid flow flows through the mud motor, the fluid passes through the cavities formed between the rotor and the stator.

This rotation of the rotor may be used to generate electrical or rotational power downhole of the mud motor. For example, the rotation of the rotor may be used to provide the rotational energy for a casing cutter.

Thus, when the flow diversion valve is located in the closed position, the fluid flow may flow through the central bore to the mud motor. When the fluid flow is above a minimum fluid flow, the fluid flow may drive the mud motor. This may allow the mud motor to operate while the flow diversion valve is in the closed position. For example, the mud motor may be used to drive a casing cutter used to cut a section of the inner casing.

In the open position, the flow diversion valve has been lowered below the upper end (e.g., the stump) of the inner casing. As the flow diversion valve is lowered below the upper end, the flow switch engages the inner casing. Contact with the upper end causes the outer portion to rotate about the pin (i.e., clockwise). This causes the inner portion to push the flow diverter downward.

Pushing the flow diverter downward may cause the sleeve port and the housing port to be uncovered. This may open a hydraulic pathway between the central bore and the annulus. In other words, this may cause the fluid flow to be short-circuited to the annulus from the central bore 436. For example, at least a first portion of the fluid flow may pass through the sleeve port and the housing port to the annulus. In some embodiments, the first portion may be an entirety of the fluid flow. In other words, an entirety of the fluid flow may pass from the central bore to the annulus.

In some embodiments, the first portion may be less than an entirety of the fluid flow, and a second portion may flow through the central bore to the mud motor. In some embodiments, the first portion and the second portion may have the same volumetric (e.g., mass) flow rate. In some embodiments, the first portion may have a higher volumetric flow rate than the second portion. In some embodiments, the first portion may have a lower volumetric flow rate than the second portion.

The second portion may have flow rate that is less than the minimum flow rate sufficient to operate the mud motor. Thus, when the flow diversion valve is open, or in the open position, the mud motor may not operate (e.g., the rotor may not rotate, or the mud motor may stall). In this manner, the mud motor may be shut off while still pumping drilling mud through the central bore. Cycling the mud motor off may allow other downhole tools to be operated independent of the mud motor. For example, the casing removal system may be used to cycle between pulling on the inner casing and cutting a portion of the inner casing with a casing cutter. This may allow a portion of the inner casing to be removed in a single trip, thereby saving time and money.

A flow diversion valve may include an opening in a housing. A stop plate extends through the opening and into an annulus between the housing and an outer casing. The stop plate extends into a valve chamber and contacts a bottom of a sleeve. The sleeve extends into the central bore and down past a flow diverter. In some embodiments, a sleeve port in the sleeve may be obstructed by the flow diverter. A housing port is open to the annulus and the valve chamber. In this manner, in the open position or the closed position, a fluid flow through the central bore may pass by the sleeve port and travel down to the mud motor.

In the open position, the housing has been lowered until the stop plate contacts an upper edge of the inner casing. As the housing is further lowered, the sleeve slides uphole relative to the housing and the flow diverter. In some embodiments, the flow diverter may be fixed to or fixed relative to the housing. As the sleeve slides uphole, the sleeve port may become uncovered or exposed by the flow diverter.

Uncovering the sleeve port may open the flow diversion valve. This may cause at least a portion of the fluid flow to flow through the sleeve port, into the valve chamber and into the annulus through the housing port. Thus, in the lower or the open position, the flow diversion valve may create a hydraulic short-circuit for the fluid flow to flow through. In some embodiments, the portion may include a majority of the fluid flow. In some embodiments, the portion may divert sufficient fluid flow such that a mud motor below the flow diversion valve does not have sufficient fluid flow to operate. In this manner, by opening the flow diversion valve, a hydraulically operated downhole tool (such as a jack) may operate independently of, or non-simultaneously with, the mud motor. This may allow the jack to pull on the inner casing a first time, the mud motor to turn a casing cutter and cut a section of the inner casing, and the jack to pull on the inner casing a second time in the same trip downhole. This may save time and money by limiting the number of trips in and out of downhole.

A casing removal system includes a jack, a spear, a flow diversion valve, a mud motor, and a casing cutter. The casing removal system may be lowered until the spear is lowered below the upper end (e.g., the stump) of the inner casing. The spear extends grips radially outward, which contact the inner casing. The jack may then exert an upward force on the tubular members connecting the spear to the jack. In some embodiments, the jack may engage the outer casing while exerting the upward force on the tubular members. This may allow the jack to increase the force exerted on the tubular members.

In some embodiments, the flow diversion valve may be located below the upper end of the inner casing. Therefore, the flow diversion valve is open, and a fluid flow does not flow to the mud motor with sufficient flow to operate the mud motor. Thus, despite hydraulic activation of the jack, the mud motor does not provide power to the casing cutter.

In some embodiments, the jack may not be able to remove the inner casing. Therefore, the inner casing may be cut with a casing cutter to reduce the size of the inner casing to be removed. Conventionally, to cut the inner casing, the casing removal system is tripped to the surface, the jack is removed from the drill string, and a separate milling system is installed, lowered into the wellbore, and cuts the inner casing. Then, the milling system is tripped to the surface, removed, and the jack is reinstalled on the drill string and lowered back into the hole to attempt to remove the inner casing. This is time consuming and expensive.

The casing removal system may be raised until the flow diversion valve is above the upper end of the inner casing, thereby placing the flow switches 644 through the openings 642 into the closed position. This closes the flow diversion valve, which allows the fluid flow to flow through the casing removal system to the mud motor. The mud motor may then drive the casing cutter, which cuts a portion of the inner casing with one or more expandable reamers. By including the flow diversion valve, the casing cutter may be located on the same drill string as the jack. This may save two or more complete trips (i.e., one to remove the jack and install the casing cutter, and one to remove the casing cutter and install the jack) out of and back into the wellbore. This saves considerable time, and therefore money, in a drilling operation.

The flow diversion valve may be lowered below the upper end of the inner casing. The spear has extended the grips to the inner casing. The jack has pulled on the connecting tubular member sufficient to break the inner casing free from the outer casing. At this point, the casing removal system may be tripped up to the surface, and the inner casing removed from the wellbore.

It should be understood that this process may be repeated indefinitely until the inner casing is removed. Specifically, the inner casing may be cut into smaller and smaller lengths if the jack remains unable to break the inner casing free from the outer casing. For example, the casing cutter may cut a first cut at a first borehole depth. If the jack is unable to remove the inner casing, then the casing cutter may make a second cut at a second borehole depth uphole of the first borehole depth. However, it should be understood that the casing cutter may make any number of cuts to the inner casing until the jack can remove the cut section of the inner casing. This is because the flow diversion valve resets between positions. Thus, no matter how many times the inner casing is cut, the casing removal system may remain downhole until the inner casing is removed.

In some embodiments, a connector between the flow diversion valve and the mud motor and/or between the mud motor and the casing cutter may extend a length between the flow diversion valve and the casing cutter. This may allow the casing removal system to remove greater lengths of the inner casing. Removing greater lengths of the inner casing may reduce the total number of trips used to remove a desired length of the inner casing.

It should further be understood that this process may begin at any point described herein. For example, a drill operator may desire to cut a portion of the inner casing before attempting to remove the inner casing. Therefore, the casing removal system may first be lowered into the closed position and the inner casing cut with the casing cutter without attempting to removing the inner casing first. Similarly, the casing removal system may successfully dislodge and remove the inner casing on the first attempt, without cutting the inner casing. Nevertheless, the casing removal system of the present disclosure allows for the process to begin at any of the points discussed, and to cycle through each of the positions or steps discussed until the inner casing is dislodged from the outer casing.

The embodiments of the casing removal system have been primarily described with reference to wellbore drilling operations; the casing removal systems described herein may be used in applications other than the drilling of a wellbore. In some embodiments, casing removal systems according to the present disclosure may be used outside a wellbore or other downhole environment used for the exploration or production of natural resources. For instance, casing removal systems of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A string of tools for removing casing from a wellbore, comprising:

a jack configured to exert an upward force on tools that are downhole from the jack;

a spear configured to attach to a casing;

a mud motor downhole of the spear, the mud motor operating in response to receiving a fluid flow flowing through the tool string; and a valve located within the tool string between the jack and the mud motor that is configured for controlling the flow of fluid to the mud motor;

wherein the valve comprises:

a housing with upper and lower ends for coupling with the tool string;

at least one control member that extends beyond an outer diameter of the housing under the influence of a biasing force and is configured to be moved by passing the housing from an outer casing into an inner casing that has an inner diameter smaller than the inner diameter of the outer casing.

2. The string of tools of claim 1, wherein the at least one control member comprises a moveable switch that is configured to rotate from a first switch position to a second switch position in response to contact with an upper end of the second casing, the rotation of the at least one moveable switch from the first switch position to the second switch position causing a flow diverter in the interior of the housing to move between a first position and a second position, wherein movement between the first position and the second position alters the fluid flow flowing to the mud motor flow diverter.

3. The string of tools of claim 2, wherein the housing has a port for communicating fluid from the fluid flow from the interior of the housing to the exterior of the housing in response to movement of the flow diverter, causing a drop in fluid flow to the mud motor.

4. The string of tools of claim 1, wherein valve is configured to restrict fluid flow exiting the lower end of the housing in response to the control member moving with respect to the housing, the restriction of fluid flow reducing fluid flow to the mud motor and allowing for building of pressure in the fluid in the string above the valve.

5. The string of tools of claim 1, wherein the valve restricts fluid flow through the lower end of the housing when the control member extends from housing and opens fluid flow through the lower end of the housing when the control member is moved by passing the housing from the outer casing to the inner casing.

6. The string of tools of claim 1, wherein the valve restricts fluid flow through the lower end of the housing when the control member extends from housing and opens fluid flow through the lower end of the housing when the control member is moved by passing the housing from the outer casing to the inner casing.

7. A method for controlling fluid flow between a first tool and a second tool in a tool string lowered from the surface into a cased wellbore, the cased wellbore having a first wellbore casing and a second wellbore casing of a smaller diameter than the first wellbore casing, the second wellbore casing having an upper end terminating inside the first casing; the method comprising:

flowing a fluid from the surface under pressure to the tool string, the tool string further comprising a valve between a first tool and a second tool, the valve comprising, an external housing with upper and lower ends for connecting with and forming part of the tool string, the valve being configured for the fluid from the surface to be received through the upper end of the external housing and to exit the valve through the lower end of the external housing, the valve being further configured to have a plurality of fluid control states, each of the plurality of fluid control states corresponding to a plurality of different rates of fluid flow exiting the lower end of the external housing, the plurality of fluid control states including at least a first control state and a second control state; and at least one control member, the at least one control member extending beyond an outer diameter of the housing under the influence of a biasing force and being configured to move with respect to the external housing when the valve moves past the upper end of the second wellbore casing, wherein the valve is configured for the movement of the at least one moveable control member to actuate the valve to change the fluid flow existing the lower end of the housing, lowering the tool string past the upper end of the second wellbore casing to cause the control member to move and thereby change the valve between the first fluid control state to the second fluid control state.

8. The method of claim 7, wherein movement of at least one control member causes a flow diverter in the interior of the external housing of the valve to open and close a port in the external housing, through which fluid from the fluid flow may exit the tool string, thereby changing the fluid control state of the actuatable valve.

9. The method of claim 8, wherein, in the first fluid control state, the port is relatively closed as compared the second fluid control state, and wherein lowering the housing into the second wellbore casing causes the flow diverter to open the port to allow fluid to flow through the port, thereby reducing a flow rate of the fluid from the lower end of the external housing in the second fluid control state.

10. The method of claim 7, wherein, the valve restricts flow through the lower end of the housing in the first fluid control state and allows a higher flow rate in the second fluid control state; and lowering the housing into the second casing increases the flow rate of the fluid flow from the lower end of the external housing.

11. A downhole tool assembly comprising a plurality of tools connected into a string for lowering into a cased wellbore and configured to be supplied with fluid under pressure, the plurality of tools comprising:

a first tool, a second tool, and an externally actuatable valve positioned within the downhole tool assembly between the first and second tools for controlling communication of fluid through the tool assembly to at least the second tool, the externally actuatable valve comprising:

an external housing with upper and lower ends for connecting with other of the plurality of tools in the tool assembly;

the externally actuatable valve being configured for fluid to be received through the upper end of the external housing and to exit the valve through the lower end of the external housing, the valve being further configured to have a plurality of fluid control states, each of the plurality of fluid control states corresponding to one of a plurality of different rates of fluid flow exiting the lower end of the external housing, the plurality of fluid control states including at least a first control state and a second control state; and at least one control member that extends beyond an outer diameter of the tool assembly under the influence of a biasing force, the control member being configured for movement with respect to the outer housing to cause the externally actuatable valve to change the fluid control state of the valves in response to the movement.

12. The downhole tool assembly of claim 11, wherein the at least one control member is configured to cause a flow diverter within an interior of the external housing of the externally actuatable valve to move positions, and wherein the flow diverter is configured to change a change the fluid control state between the first fluid control state and the second fluid control state.

13. The downhole tool assembly of claim 12, wherein the at least one control member comprises a moveable switch that is configured to rotate inwardly to cause the flow diverter to move.

14. The downhole tool assembly of claim 12, wherein the actuatable valve further comprises a port formed in the outer housing, through which fluid from the interior of the outer housing can be communicated to outside the tool assembly in response to movement of the flow diverter, thereby causing a drop in fluid flow to at least the second tool.

15. The downhole tool assembly of claim 11, wherein the externally actuatable valve in the second fluid control state restricts fluid flow through the lower end of the external housing of the valve in response to movement inwardly of the at least one control member.

16. The downhole tool assembly of claim 11, wherein the valve restricts flow through the housing to build pressure in the fluid flow in the tool assembly above the externally actuatable valve without communicating fluid from the interior to the outer housing to the exterior of the downhole tool assembly.

17. The downhole tool assembly of claim 11, wherein the first tool comprises a jack and the second tool comprises at least a mud motor driving a cutter capable of cutting or milling casing.

* * * * *